US008813811B1

(12) United States Patent
Bauer et al.

(10) Patent No.: US 8,813,811 B1
(45) **Date of Patent: *Aug. 26, 2014**

(54) FORMING A MOLD FOR STEEL CASTING

(71) Applicant: Amsted Rail Company, Inc., Chicago, IL (US)

(72) Inventors: Tony Bauer, Edwardsville, IL (US); Thomas Callahan, Maryville, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/799,713

(22) Filed: Mar. 13, 2013

(51) Int. Cl.
*B22C 9/22* (2006.01)
*B22C 9/02* (2006.01)

(52) U.S. Cl.
USPC ..... 164/21; 164/22; 164/29; 164/37; 164/202

(58) Field of Classification Search
USPC ..... 164/19–22, 29, 37, 200–202
See application file for complete search history.

(56) References Cited

U.S. PATENT DOCUMENTS

| | | | | |
|---|---|---|---|---|
| 3,122,801 | A * | 3/1964 | Merrefield | 164/21 |
| 4,195,682 | A * | 4/1980 | Muller | 164/6 |
| 5,752,564 | A | 5/1998 | Callahan et al. | |
| 6,662,853 | B2 * | 12/2003 | Bauer et al. | 164/137 |
| 2003/0205349 | A1 * | 11/2003 | Hunter | 164/19 |

* cited by examiner

*Primary Examiner* — Keith Walker
*Assistant Examiner* — Kevin E Yoon
(74) *Attorney, Agent, or Firm* — Edward J. Brosius

(57) ABSTRACT

A method of forming a mold for use in the casting of a steel railway freight car truck component is provided. A cope mold is formed by providing a near net shape oversize impression of a cope pattern of a product to be cast in a flask. A cope pattern of the product to be cast is then placed on the flask forming a spacing between the cope pattern and the oversize impression. A resin coated sand is then blown to form a sand layer between the oversized impression in the flask and the cope pattern. The resin sand is set to form a mold of a thickness between the oversized impression in the flask and the cope pattern of the product to be cast. The drag mold is formed in a similar manner.

20 Claims, 18 Drawing Sheets

FORMING A MOLD FOR STEEL CASTING

BACKGROUND OF THE INVENTION

The present invention relates to a method of forming a mold for use in casting steel products, and, more particularly, to a method of forming a mold for use in the manufacture of steel castings such as holsters, sideframes, couplers, yokes, draft sills and related components for railway freight car trucks.

Traditionally, such steel castings for railway freight car trucks are comprised of cast steel components that are unitary in structure. Such steel castings are typically comprised of steel that is poured into green sand molds. Such green sand molds are typically formed by the injection and compaction of green sand, of which clay is the binder element, by a slinger into a cope or drag pattern placed in a flask. Alternately, such flask can be placed over the cope or drag pattern and green sand is poured to fill the flask, whereupon the flask is jolted to set the green sand cope or drag pattern in the flask.

The formation of the cope and drag halves of the mold for use in forming such cast steel components has a major disadvantage in that an assembled bolster mold comprised of a bottom or drag half and a top or cope half, comprises over 4,000 pounds of green sand, not including the cores placed into the drag half before the cope half is placed on top to form a complete mold for pouring. Such large quantity of green sand must be reclaimed after the molten steel is poured into the bolster mold before the sand can be reused to form another bolster mold. Similar amounts of sand are required in the casting of a sideframe or a draft sill, with lesser, but still substantial, amounts of sand for casting a coupler body or a coupler yoke. Such processing of such large amounts of sand is both time consuming and expensive.

Accordingly, it is an object of the present invention to provide a more efficient method of forming a mold for use in the casting of a steel bolster, sideframe, coupler, yoke, draft sill or other cast steel component of a railway freight car truck.

Another object of the present invention is to provide an inherently more dimensionally accurate bolster, sideframe, coupler, yoke, draft sill or other cast steel component of a railway freight car truck by the use of a permanent flask lined with a resin coated sand, formed to a pattern.

SUMMARY OF THE INVENTION

The present invention provides a more efficient and dimensionally accurate method of forming a mold for use in the casting of a steel bolster, sideframe coupler, yoke, draft sill or other cast steel component of a railway freight car truck.

A drag half flask for use in the forming of a mold for the casting of a steel bolster, sideframe, coupler, yoke, draft sill or other cast steel component of a railway freight car truck is formed by utilizing a drag casting pattern for the drag half of the cast steel component. A near net shape oversized impression of the drag casting pattern for the component is formed in the drag flask. The degree that the near net shape oversized impression formed in the drag half of the flask is larger than the drag pattern for the component is an engineered volume, and is typically 3 to 15 percent larger than the drag pattern for the component.

Similarly, a cope half flask for use in the forming of a mold for the casting of a steel bolster, sideframe, coupler, yoke, draft sill or other cast steel component of a railway freight car truck is formed by utilizing a cope casting pattern for the cope half of the cast steel component. A near net shape oversized impression of the cope casting pattern for the component is formed in the cope flask. The degree that the near net shape oversized, impression formed in the cope half of the flask is larger than the cope pattern for the component is an engineered volume, and is typically 3 to 15 percent larger than the cope pattern for the component.

Such flasks are typically made of cast steel, and are also typically comprised of a single piece, but can be comprised of two or three or four sections that can be bolted or welded together. In this manner, if one section wears prematurely it can be replaced without the need to replace the entire flask.

The drag flask, with the near net shape oversized impression of the drag pattern therein, is used as a base to receive the actual pattern for the drag half of the cast steel component which is placed on top. There is a spacing or opening formed between the actual drag half of the pattern for the cast steel component and the near net shape oversized impression formed in the drag flask. It should be understood that it is matter of design and manufacturing choice if the actual drag pattern is placed above the drag flask or if the drag flask were placed above the actual drag pattern.

When the drag half of the pattern is placed on top of the drag flask, the combined drag flask and drag pattern are placed into a sand blowing machine. Openings are engineered and placed in the plate or support structure of the drag pattern and also through the drag pattern itself. The sand blowing machine is utilized to inject resin coated sand through the openings to fill the space formed between the drag pattern of the component and the near net shape oversized impression formed in the drag flask. The thickness of such resin coated sand is engineered to comprise the necessary thickness to allow pouring of molten steel to form the cast steel component without damage to the drag flask. Such sand thickness is usually 0.5 to 1.5 inches (1.2 to 3.7 cm) or more.

The cope flask, with the near net shape oversized impression of the cope pattern therein, is used as a base to receive the actual pattern for the cope half of the cast steel component which is placed on top. There is a spacing or opening formed between the actual cope half of the pattern for the cast steel component and the near net shape oversized impression formed in the cope flask. It should be understood that it is matter of design and manufacturing choice if the actual cope pattern is placed above the cope flask or if the cope flask were placed above the actual cope pattern.

When the cope half of the pattern is placed on top of the cope flask, the combined cope flask and cope pattern are placed into a sand blowing machine. Openings are engineered and placed in the plate or support structure of the cope pattern and also through the cope pattern itself. The sand blowing machine is utilized to inject resin coated sand through the openings to fill the space formed between the cope pattern of the component and the near net shape oversized impression formed in the cope flask. The thickness of such resin coated sand is engineered to comprise the necessary thickness to allow pouring of molten steel to form the cast steel component without damage to the cope flask. Such sand thickness is usually 0.5 to 1.5 inches (1.2 to 3.7 cm) or more.

A gas catalyst is then injected in the drag flask through the drag pattern to set the resin coated sand placed in the opening between the drag pattern and the near net shape drag oversized impression formed in the drag flask. Similarly, a gas catalyst is injected through the cope frame and pattern to set the resin coated sand formed in the opening between the cope pattern and the near net shape cope oversized impression formed in the cope flask.

The patterns are then removed from both the drag flask and the cope flask thereby leaving a drag mold formed in the drag flask by the resin set sand which lines the near net shape opening in the drag flask. Similarly, a cope mold is formed in the cope flask by the resin coated sand filling the near net shape opening in the cope flask.

One or more cores are then placed in the drag flask as the engineered design of the cast steel component dictates. The cope flask is then closed on top of the drag flask, with the cores therein to form a complete mold ready for pouring of molten steel to form the cast steel component for the railway freight car truck.

DETAILED DESCRIPTION OF THE INVENTION

Figure 1:
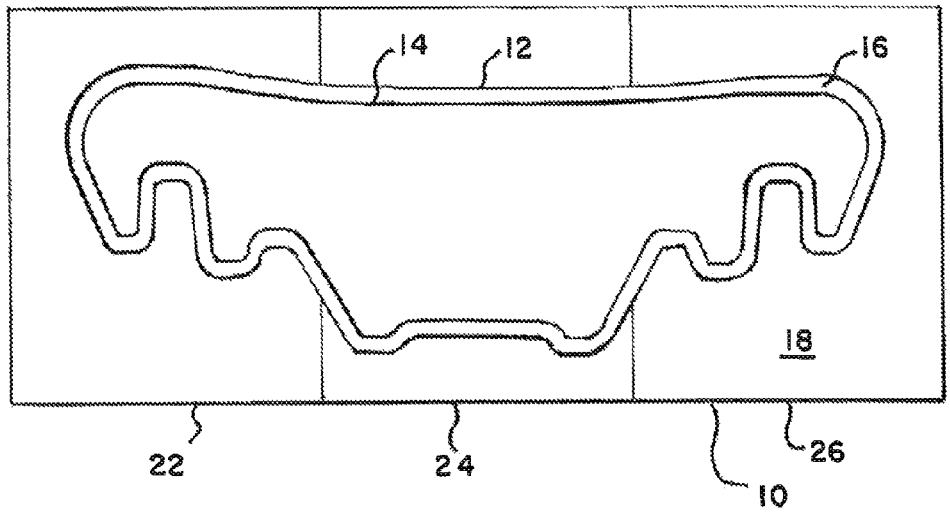
FIG. 1 is a top view of a sideframe drag mold formed in a sideframe drag flask in accordance with an embodiment of the present invention.
Figure 2:
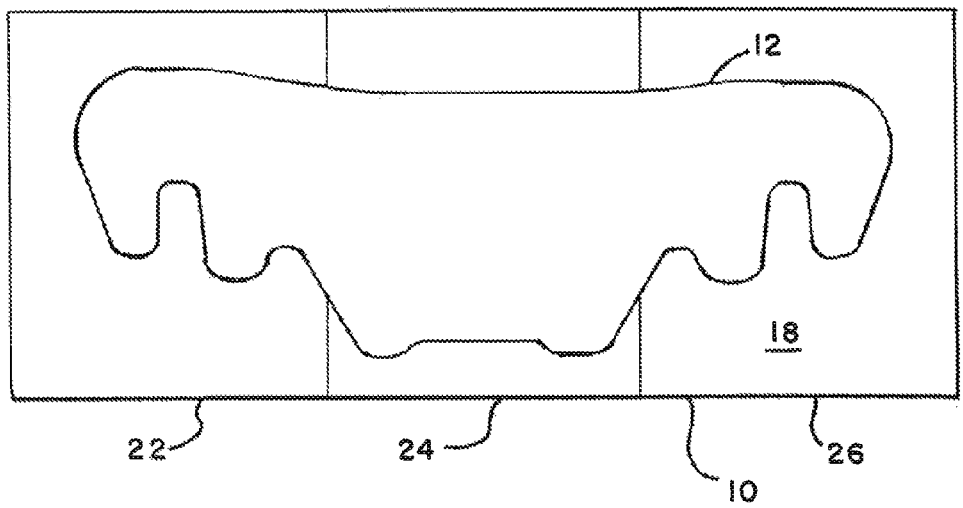
FIG. 2 is a top view of a sideframe drag flask with a near net shape oversize impression of a sideframe drag pattern formed therein in accordance with an embodiment of the present invention.

Referring now to FIGS. 1 and 2, a sideframe drag flask is shown generally at 10. Such sideframe drag flask 10 is typically comprised of cast steel sections 22, 24, and 26, with each section bolted together as shown and will be described below with reference to FIG. 4. However, sideframe drag flask 10 may also be comprised of a single piece, usually a steel casting.

Each component sideframe drag flask section is comprised of cast steel with an near net shape oversized impression of a sideframe drag pattern formed as 12 on the top surface 18 of sideframe drag flask 10. Engineering judgment and foundry practice is used in the degree of oversizing required for near net shape oversized impression 12 of the sideframe drag flask. The reason for such engineering judgment is that an exact pattern of the sideframe drag will be placed on top of sideframe drag flask 10; accordingly, a spacing will be formed between pattern edge 14 and oversized impression 12. A resin sand will form resin sand layer 16 between pattern edge 14 and oversized impression 12 in sideframe drag flask 10. The thickness of resin sand layer 16 is based on engineering design and foundry practice and typically will be between 3 and 15 percent larger than the volume formed by sideframe drag pattern edge 14. Another engineering judgment applying to the resin sand layer 16 is the overall thickness of such resin sand layer; a typical thickness of such resin sand layer will be 0.5 to 1.5 inches (1.2 cm to 3.8 cm) or more.

It should be understood that the preferred material for sideframe drag flask 10 is cast steel, but certainly cast iron could be utilized as well. It should also be understood that foundry practice may prefer that the drag flask is placed over the pattern to form the opening therebetween.

Figure 4:
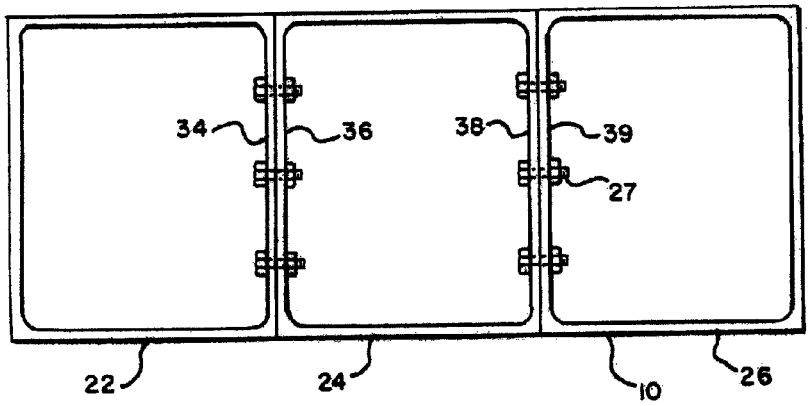
FIG. 4 is a view of the underside of a drag flask for a sideframe in accordance with an embodiment of the present invention.

Referring now to FIG. 4, separate sections 22, 24, and 26 of sideframe drag flask 10 are shown in a bottom view. In order to save weight and material, each of sections 22, 24, and 26 of sideframe drag flask 10 are generally hollow structures with a framing utilized for strength. Such framing typically comprises the outside edges, with internal edge 34 of section 22 being bolted or welded to sidewall 36 of middle section 24. The other sidewall 38 of middle section 24 is bolted by bolt nut combination 27 to the sidewall 39 of section 26 of sideframe drag flask 10. Other methods of joining the three or more sections of sideframe drag flask 10 could include welding or other equivalent methods of joining the adjacent internal walls 34 to 36 and 38 to 39.

Figure 3:
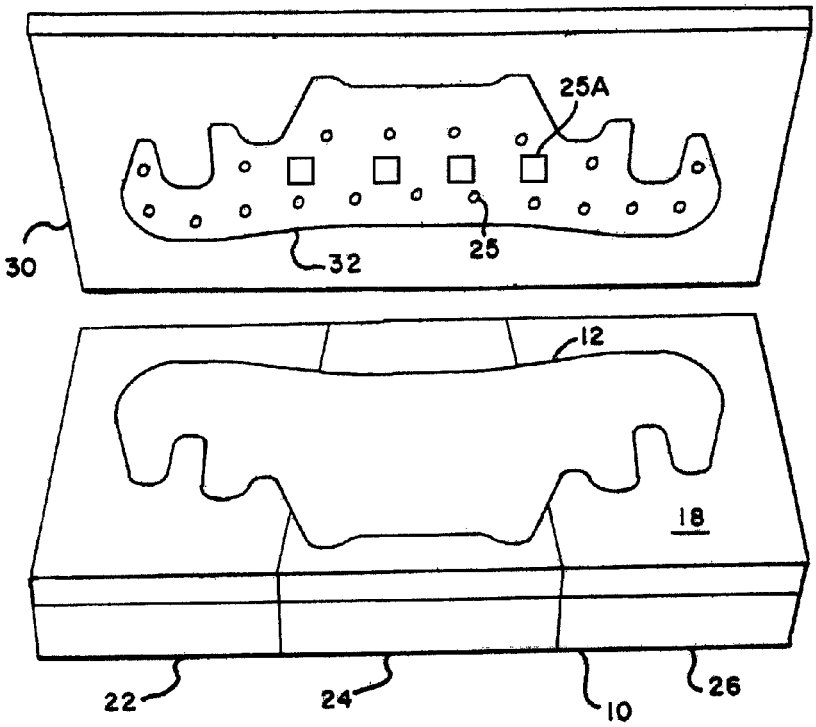
FIG. 3 is a perspective view of a drag portion of a sideframe pattern above a drag flask with a near net shape oversize impression of a sideframe drag pattern therein in accordance with an embodiment of the present invention.

Referring now to FIG. 3, sideframe drag pattern support structure or plate 30 is shown in a perspective view above sideframe drag flask 10. Sideframe drag pattern 32 is affixed to sideframe drag pattern support structure 30. Further, sand injection openings 25 are placed in an engineered design fashion throughout sideframe drag pattern 32 and through plate 30. Some of sand injection openings 25 do not extend through sideframe drag pattern 32, but rather extend through plate 30. Such sand injection openings 25 typically are comprised of openings to allow the passage of sand, and also for the passage of a catalyst gas, through sideframe drag pattern support structure 30 and sideframe drag pattern 32. In addition to sand injection openings 25, a number of exhaust openings 25A with screens are provided in sideframe drag pattern 32 and drag pattern support structure 30. These exhaust openings 25A are mainly in areas that will not receive steel to form the casting.

Figure 5:
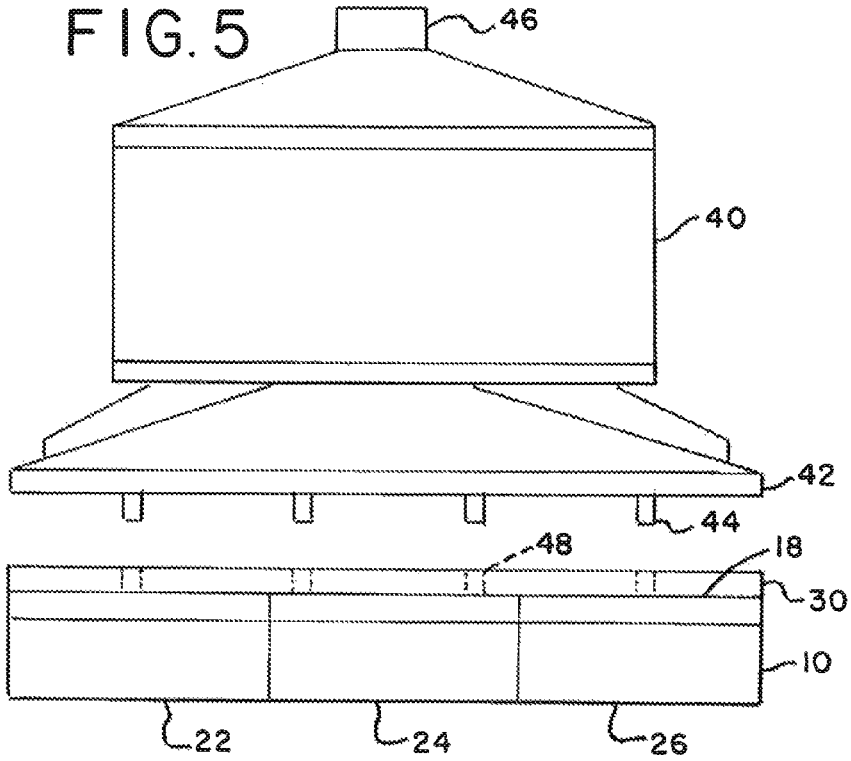
FIG. 5 is a side view of a drag portion of a sideframe pattern in a sand blowing machine above a drag flask in accordance with an embodiment of the present invention.

Referring now to FIG. 5, sand blowing machine for use with sideframe drag flask 10 and sideframe drag pattern 32 is shown generally at 40. Such sand blowing machine is comprised of a generally rectangular structure having an upper sand blowing machine connection 46 whereby resin coated sand from a sand hopper is allowed to flow into sand blowing machine 40. Sand blowing machine 40 also includes a sand blowing machine plate 42 which includes sand blow tubes 44 that are designed in an engineered fashion to correspond with sand injection openings 25 in sideframe drag pattern 32. When sideframe drag pattern 10 has sideframe pattern support structure 30 placed on top of sideframe drag flask 10, it is noted that sideframe drag pattern support structure 30 includes sand injection openings 48 correspond with sand injection openings 25 in sideframe drag pattern 32. When sideframe drag pattern support structure 30 is placed in contact with sand blowing machine plate 42, sand blow tubes 44 pass through sand injection openings 48 in sideframe drag pattern support structure 30. In an actual mold forming operation, a resin coated sand, most typically a gas set resin, is used, but it should be understood that other resins can be used to coat sand prior to injection into the spacing between sideframe drag pattern 32 and oversized impression 12 in the sideframe drag flask 10. Such sand injection forms resin sand layer 16 between sideframe drag pattern 32 and oversized impression 12 in sideframe drag flask 10.

Figure 6:
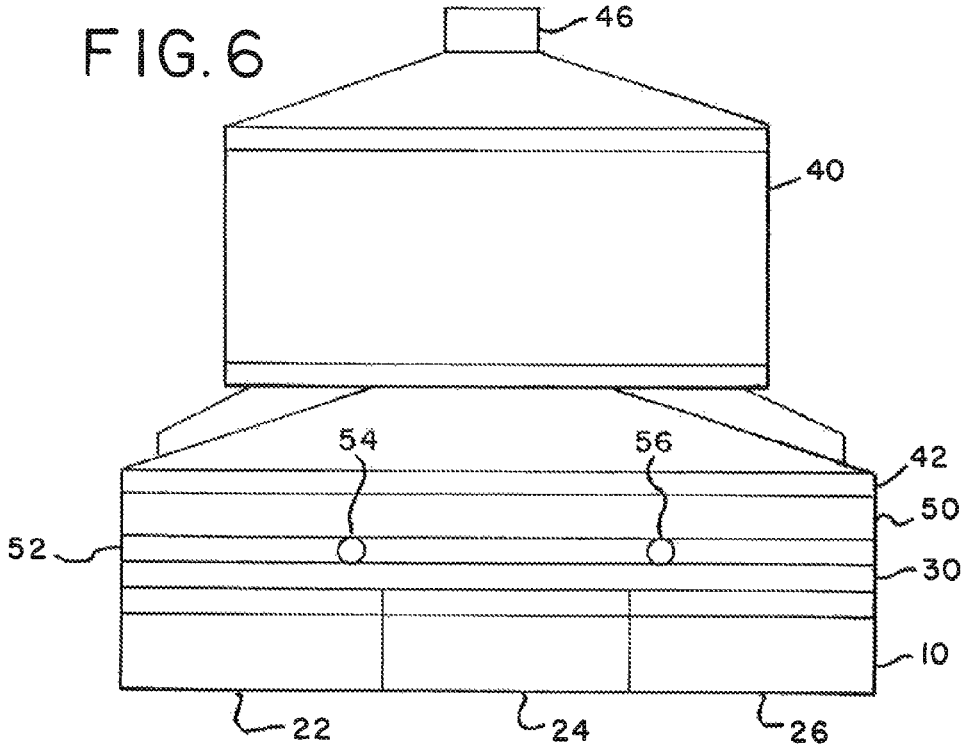
FIG. 6 is a side view of a gassing plate in a sand blowing machine positioned on top of a drag portion of a sideframe pattern positioned on top of a sideframe drag flask in accordance with an embodiment of the present invention.

Referring now to FIG. 6, a gas injection plate 50 for a sideframe drag pattern is placed between sand blowing machine header 42 and sideframe drag pattern support structure 30. Gas injection plate 50 for sideframe drag section is seen to include a gas injection plate dispersion section 52 which is placed adjacent sideframe pattern support structure 30. Gas injection plate dispersion section 52 is seen to include gas injection inlets 54 and 56.

The operation of the gas injection plate 50 usually includes the injection of a gas catalyst which reacts with the resin coated sand to form resin sand layer 16 between pattern 14 of sideframe drag section and oversize impression 12 in the sideframe drag flask. The typical gas injection period is engineered depending on the thickness of resin sand layer 16 and the overall size of the sideframe drag pattern 32 and the number of inlet gas injection openings, also referred to as sand injection openings 25, in sideframe drag pattern 32.

Figure 7:
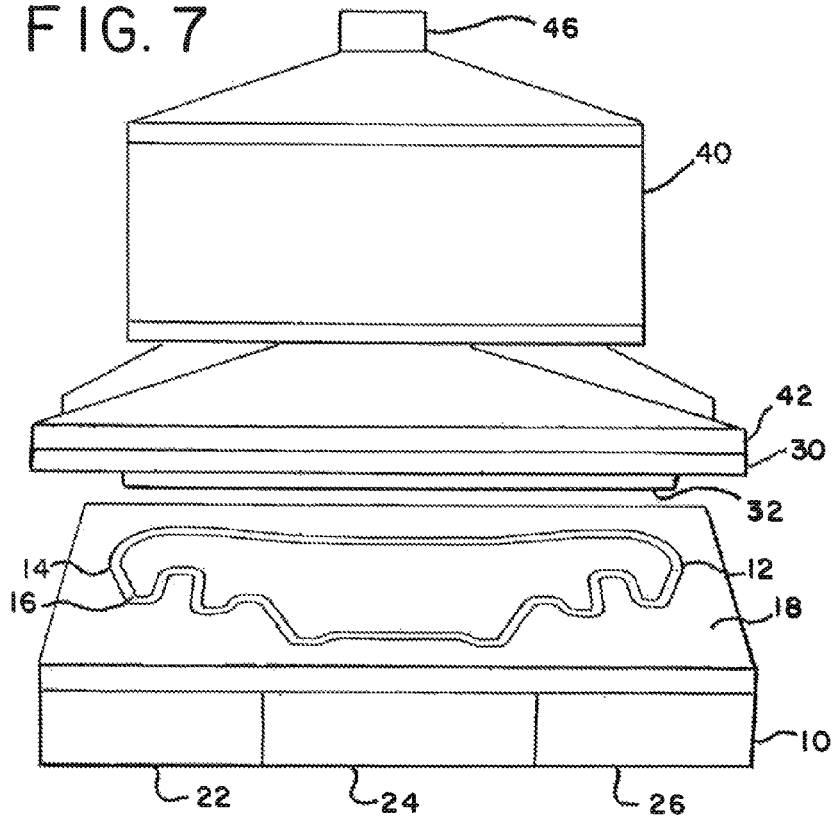
FIG. 7 is a perspective view of a drag portion of a sideframe pattern in a sand blowing machine above a sideframe drag flask after the injection of the molding sand and then the gas catalyst to form a drag mold for a sideframe in the drag flask in accordance with an embodiment of the present invention.

Referring now to FIG. 7, sand blowing machine 40 for sideframe drag pattern 32 is seen to be lifted vertically away from sideframe drag flask 10 after the injection of the resin coated sand and the gas set operation. Accordingly, a layer 16 of resin coated sand is formed in sideframe drag flask 10 between the inside dimension of sideframe drag pattern 32 and the outside dimension of the near net shape oversized impression 12 in sideframe drag flask 10.

Figure 8:
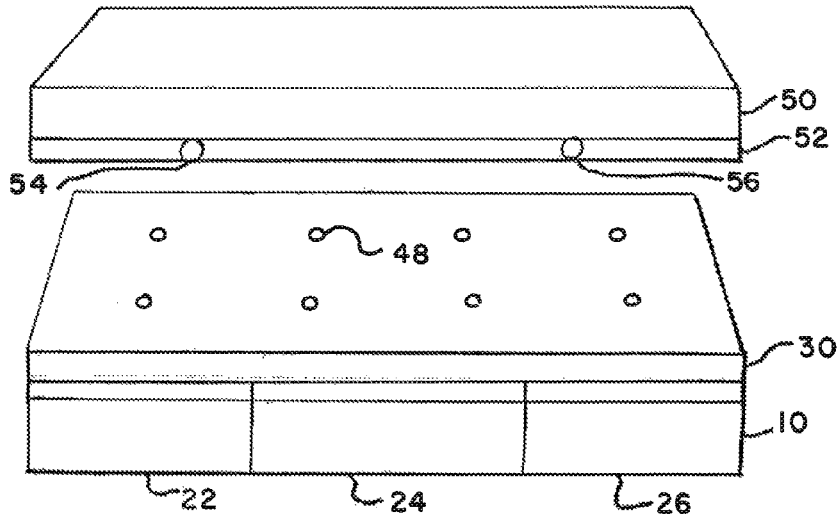
FIG. 8 is a perspective view of a gassing plate above a sideframe drag pattern on top of a sideframe drag flask in accordance with an embodiment of the present invention.

Referring now to FIG. 8, a detailed perspective view of sideframe drag flask 10 is shown with sideframe drag pattern support structure 30 thereon. Sand and gas injection openings 48 are shown in sideframe drag pattern structure 30. Further, gas injection plate 50 is shown with a gas injection plate dispersion section 52 as a bottom section thereof with gas injection inlets 54 and 56. Most typically, gas injection plate 50 is a metal rectangular structure, having a type of sealing device such as a gasket or other designed material between gas injection plate dispersion section 52 lower outside edge and the upper surface of sideframe drag pattern support structure 30.

Figure 9:
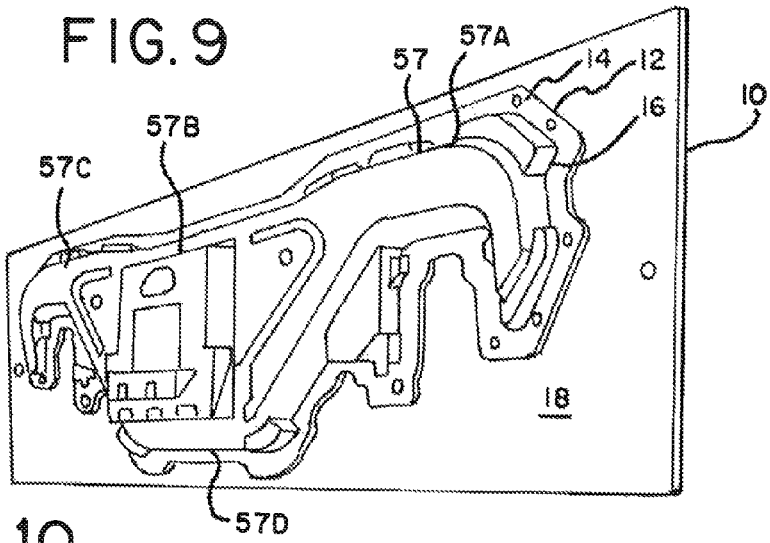
FIG. 9 is a perspective view of a sideframe drag mold in a sideframe drag flask with cores installed in accordance with an embodiment of the present invention.

Referring now to FIG. 9, a plurality of cores 57 are placed in the sideframe drag sand layer 16 formed in sideframe drag flask 10. It is seen that such sideframe drag pattern cores usually comprise an end core section 57A, a center core sections 57B, another end core section 57C, and a bottom core section 57D. Such core sections are made of a resin set sand.

Another aspect of the present invention are the weights and relative weights of the cast steel sideframe and the layer of resin coated sand formed to the drag pattern in the drag flask. Typically, a cast steel sideframe for use in a modern freight car truck weighs about 900 lb. (410 kg.). The weight of resin coated sand lining the sideframe drag flask is between 150 and 250 lb. (68 and 115 kg). Accordingly, a ratio of resin coated liner sand in the sideframe drag flask to the weight of the cast steel sideframe is about 0.2 to 1.0.

Figure 10:
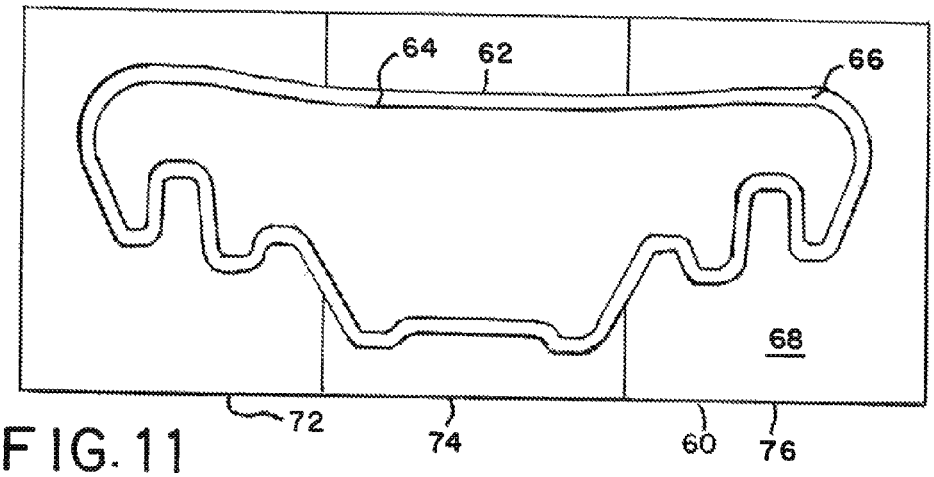
FIG. 10 is a top view of a sideframe cope mold formed in a sideframe cope flask in accordance with an embodiment of the present invention.
Figure 11:
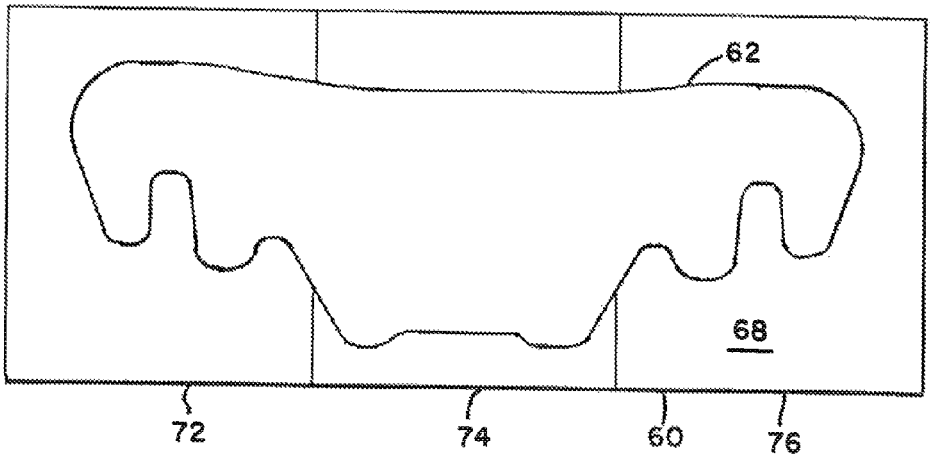
FIG. 11 is a top view of a sideframe cope flask with a near net shape oversize impression of a sideframe cope pattern formed therein in accordance with an embodiment of the present invention.

Referring now to FIGS. 10 and 11, a sideframe cope flask is shown generally at 60. Such sideframe cope flask is typically comprised of cast steel sections 62, 64, and 66, with each section bolted together as shown and will be described below with reference to FIG. 13. However, sideframe cope flask 60 may be comprised of a single piece, typically a steel casting.

Each component sideframe cope flask section is comprised of cast steel with an oversized impression of a sideframe cope portion formed as 62 on the top surface 68 of sideframe cope flask 60. Inventive engineering judgment and foundry practice is used in the degree of oversizing required for impression 62 of the sideframe cope flask. The reason for such engineering judgment is that an exact pattern of the sideframe cope will be placed on top of sideframe cope flask 60; accordingly, a spacing will be formed between pattern edge 64 and oversized impression 62. A resin sand will form resin sand layer 66 between pattern edge 64 and oversized impression 62 in sideframe cope flask 60. The thickness of resin sand layer 66 is based on inventive engineering design and foundry practice and typically will be between 3 and 15 percent larger than the volume formed by sideframe cope pattern edge 64. Another inventive engineering judgment applying to the resin sand layer 66 is the overall thickness of such resin sand layer; a typical thickness of such resin sand layer will be 0.5 to 1.5 inches (1.2 cm to 3.8 cm) or more.

It should be understood that the preferred material for sideframe cope flask 60 is cast steel, but certainly cast iron could be utilized as well. It should also be understood that foundry practice may prefer that the drag flask is placed over the pattern to form the opening therebetween.

Figure 13:
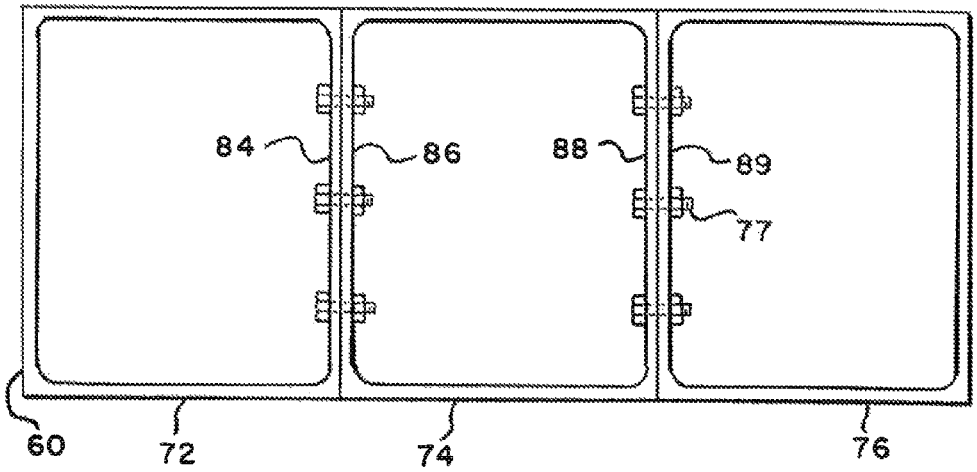
FIG. 13 is a view of the underside of a cope flask for a sideframe in accordance with an embodiment of the present invention.

Referring now to FIG. 13, separate sections 72, 74, and 76 of sideframe cope flask 10 are shown in a bottom view. In order to save weight and material, each of sections 72, 74, and 76 of sideframe cope flask 60 are generally hollow structures with a framing utilized for strength. Such framing typically comprises the outside edges, with internal edge 84 of section 72 being bolted or welded to sidewall 86 of middle section 74. The other sidewall 88 of middle section 74 is bolted by bolt nut combination 77 to the sidewall 89 of section 76 of sideframe cope flask 60. Other methods of joining the three or more sections of sideframe cope flask 60 could include welding or other equivalent methods of joining the adjacent internal walls 84 to 86 and 88 to 89.

Figure 12:
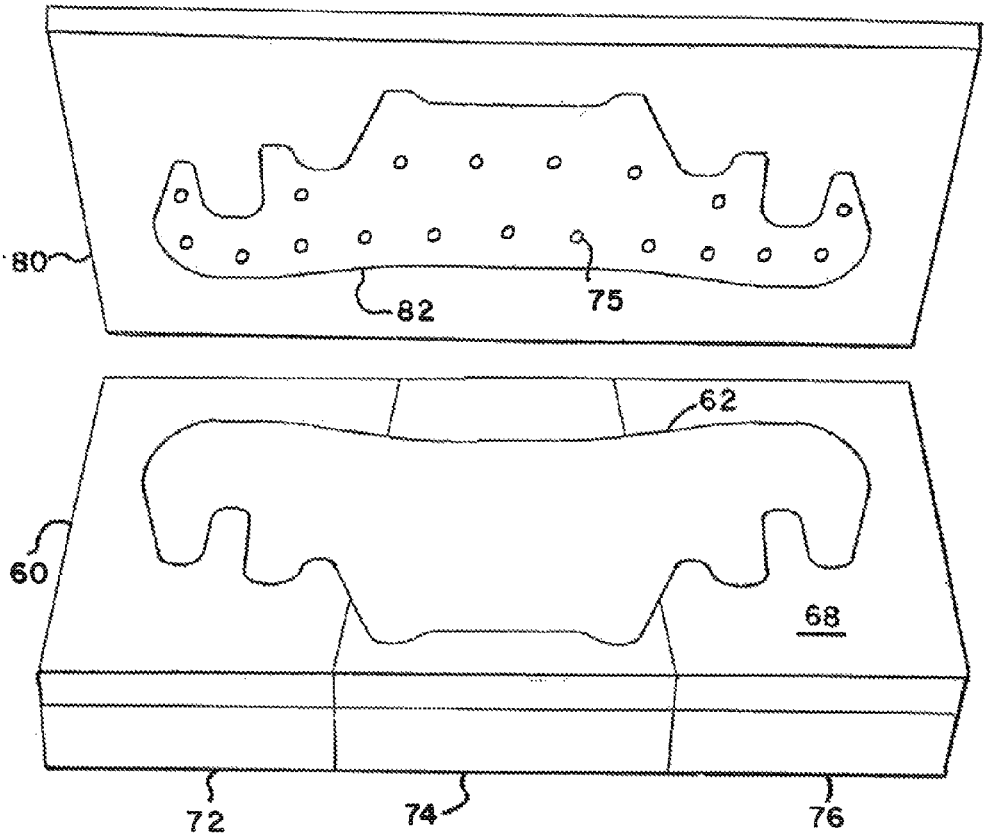
FIG. 12 is a perspective view of a cope portion of a sideframe pattern above a cope flask with a near net shape oversize impression of a sideframe cope pattern therein in accordance with an embodiment of the present invention.

Referring now to FIG. 12, sideframe cope pattern support structure or plate 80 is shown in a perspective view above sideframe cope flask 60. Sideframe cope pattern 82 is affixed to sideframe cope pattern support structure 80. Further, sand injection openings 75 are placed in an engineered design fashion throughout sideframe cope pattern 82 and through plate 80. Some of sand injection openings 75 do not extend through sideframe cope pattern 82 but extend through plate 80. Such sand injection openings typically are comprised of openings to allow the passage of sand, and also for the passage of a catalyst gas, through sideframe cope pattern support structure 80 and sideframe cope pattern 82. In addition to sand injection openings 75, a number of exhaust openings 75A with screens are provided in sideframe cope pattern 82 and cope pattern support structure 80. These exhaust openings 75A are mainly in areas that will not receive steel to form the casting.

Figure 14:
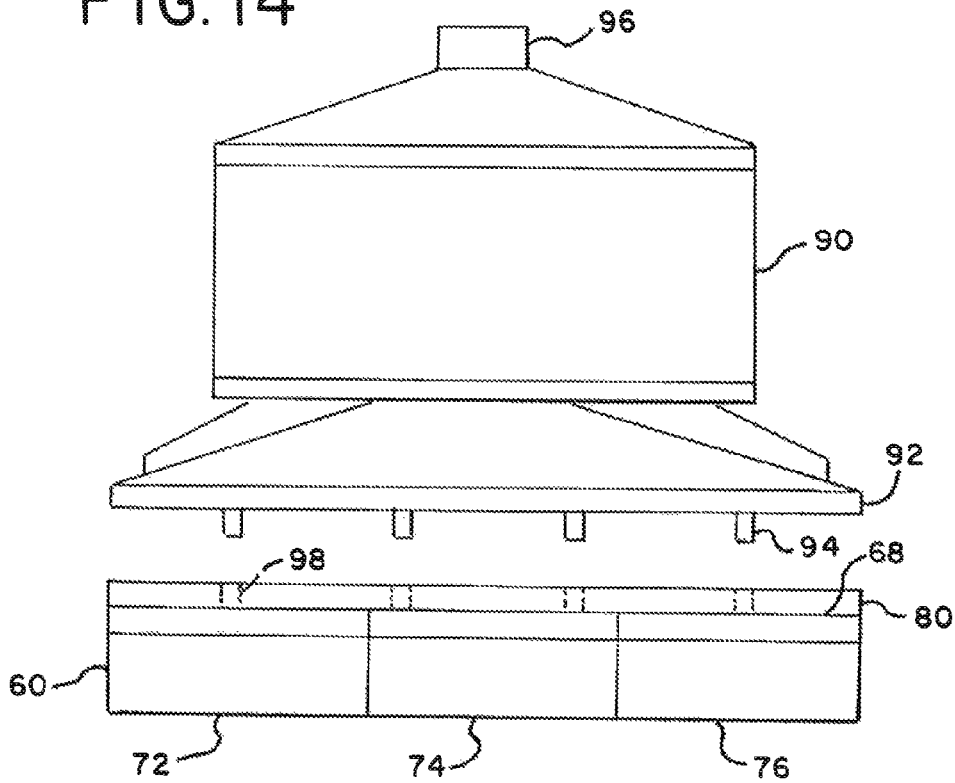
FIG. 14 is a side view of a cope portion of a sideframe pattern in a sand blowing machine above a cope flask in accordance with an embodiment of the present invention.

Referring now to FIG. 14, sand blowing machine for use with sideframe cope flask 60 and sideframe cope pattern 82 is shown generally at 90. Such sand blowing machine is comprised of a generally rectangular structure having an upper sand blowing machine connection whereby resin coated sand from a sand hopper is allowed to flow into sand blowing machine 90. Sand blowing machine 90 also includes a sand blowing machine plate 92 which includes sand brow tubes 94 that are designed in an engineered fashion to correspond with sand injection openings 75 in sideframe cope pattern 82. When sideframe cope pattern 82 and sideframe pattern support structure 80 are placed on top of sideframe cope flask 60, it is noted that sideframe cope pattern support structure 80 includes sand injection openings 98 which correspond with sand injection openings 75 in sideframe cope pattern 82. When sideframe cope pattern support structure 80 is placed in contact with sand blowing machine header 92, sand blow tubes 94 pass through sand injection openings 98 in sideframe cope pattern support structure 80. In an actual mold forming operation, a resin coated sand, most typically a gas set resin, is used, but it should be understood that other resins can be used to coat sand prior to injection into the spacing between sideframe cope pattern 82 and oversized impression 62 in the sideframe cope flask 60. Such sand blowing forms resin sand layer 66 between sideframe cope pattern edge 64 and oversized impression 62 in sideframe cope flask 60.

Another feature of the present invention is that resin sand layer 66 can be formed with a minimum number of gas vents on the pattern which allow a cast steel sideframe to be formed with a minimum number of raised projections in the steel casting that correspond to each gas vent in the pattern.

Figure 15:
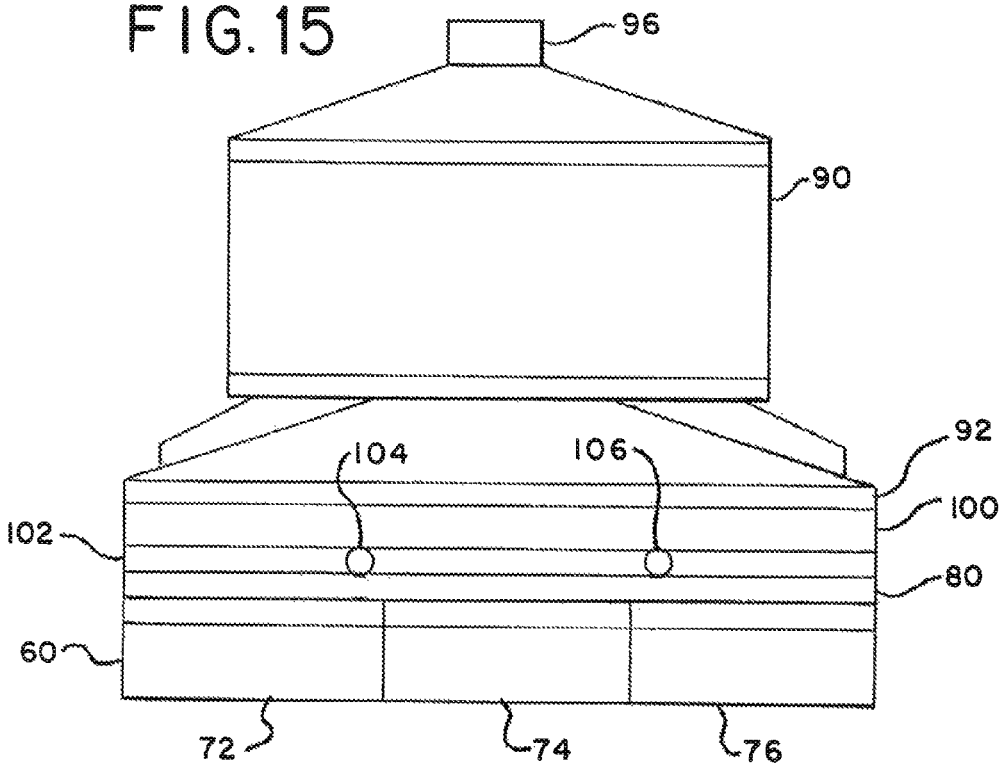
FIG. 15 is a side view of a gassing plate in a sand blowing machine positioned on top of a cope portion of a sideframe pattern positioned on top of a sideframe cope flask in accordance with an embodiment of the present invention.

Referring now to FIG. 15, a gas injection plate 100 for a sideframe cope pattern is placed between sand blowing machine header 92 and sideframe cope pattern support structure 80. Gas injection plate 100 for sideframe cope section is seen to include a gas injection plate dispersion section 102 which is placed adjacent sideframe cope pattern support structure 80. Gas injection plate dispersion section 102 is seen to include gas injection inlets 104 and 106.

The operation of the gas injection plate 100 usually includes the injection of a gas catalyst which reacts with the resin coated sand to form resin sand layer 66 between pattern 62 of sideframe cope section and oversize impression 62 in the sideframe cope flask. The typical gas injection period is engineered depending on the thickness of resin sand layer 66 and the overall size of the sideframe cope pattern 82 and the number of inlet gas injection opening, also referred to as sand injection openings 75 in sideframe cope pattern 82.

Figure 16:
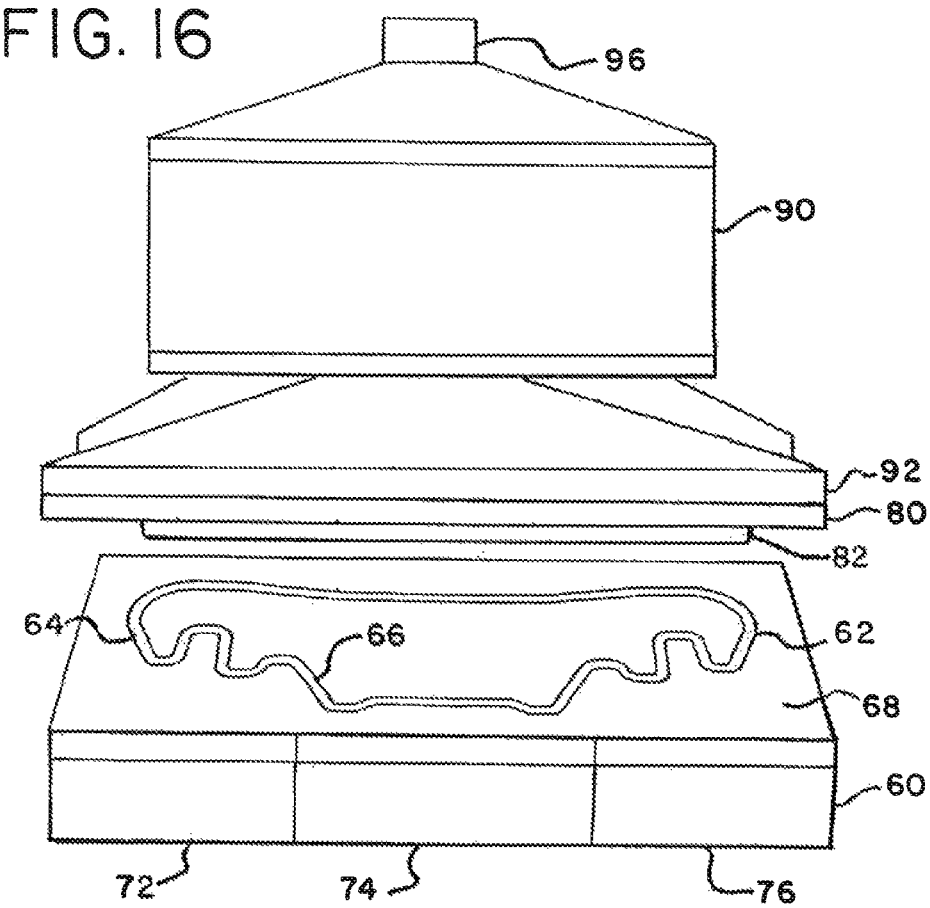
FIG. 16 is a perspective view of a cope portion of a sideframe pattern in a sand blowing machine above a sideframe cope flask after the injection of the molding sand and then the gas catalyst to form a cope mold for a sideframe in the cope flask in accordance with an embodiment of the present invention.

Referring now to FIG. 16, sand blowing machine 90 for sideframe cope pattern 82 is seen to be lifted vertically away from sideframe cope flask 60 after the injection of the resin coated sand and the gas set operation. Accordingly, a layer 66 of resin coated sand is formed in sideframe flask 60 between the inside dimension of sideframe cope pattern 82 and the outside dimension of the oversized impression 62 in sideframe drag flask 60.

Figure 17:
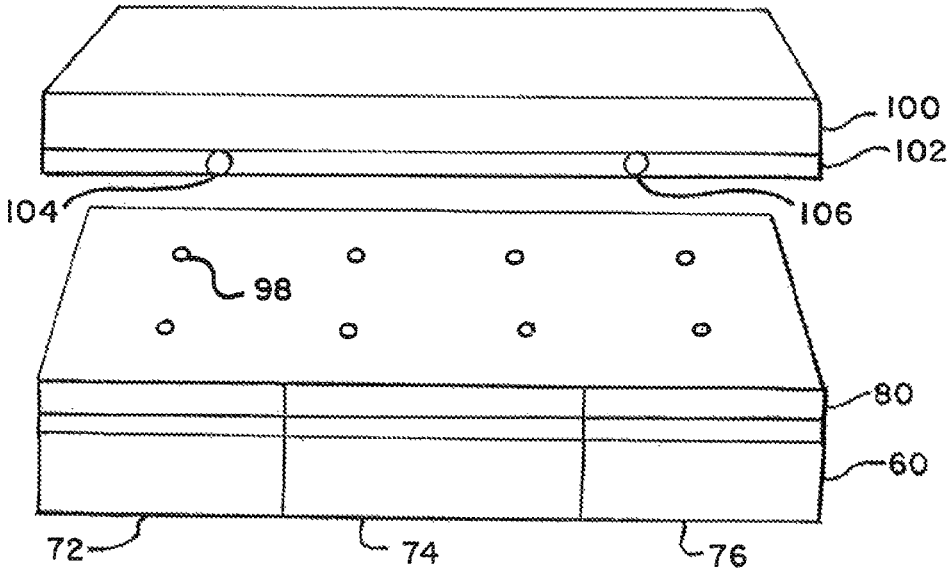
FIG. 17 is a perspective view of a gassing plate above a sideframe cope pattern on top of a sideframe cope flask in accordance with an embodiment of the present invention.

Referring now to FIG. 17, a detailed perspective view of sideframe cope flask 60 is shown with sideframe cope pattern support structure 80 thereon. Sand and gas injection openings 98 are shown in sideframe cope pattern support structure 30. Further, gas injection plate 100 is shown with a gas injection plate dispersion section 102 as a bottom section thereof with gas injection inlets 104 and 106. Most typically, gas injection plate 100 is a metal rectangular structure, having a type of sealing device such as a gasket or other designed material between gas injection header dispersion section 102 lower outside edge and the upper surface of sideframe cope pattern support structure 80.

Another aspect of the present invention are the weights and relative weight of the cast steel sideframe, and the layer of resin coated sand formed to the sideframe cope pattern in the cope flask. Typically, a cast steel sideframe for use in a modern freight car truck weighs about 900 lb. (410 kg.). The weight of resin coated sand lining the sideframe cope flask is between 150 and 250 lb. (68 and 115 kg). Accordingly, the ratio of resin coated liner sand in the sideframe cope flask to the weight of the cast steel sideframe is about 0.2 to 1.0.

Figure 18:
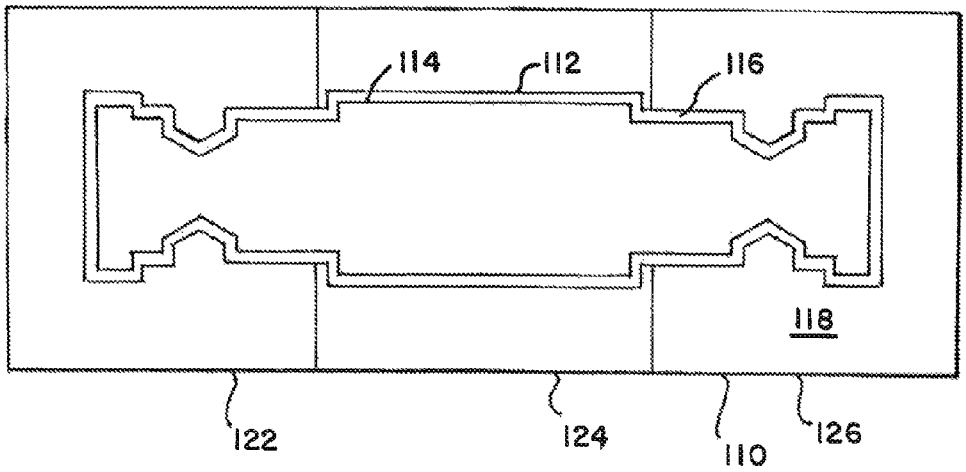
FIG. 18 is a top view of a bolster drag mold formed in a bolster drag flask in accordance with an embodiment of the present invention.
Figure 19:
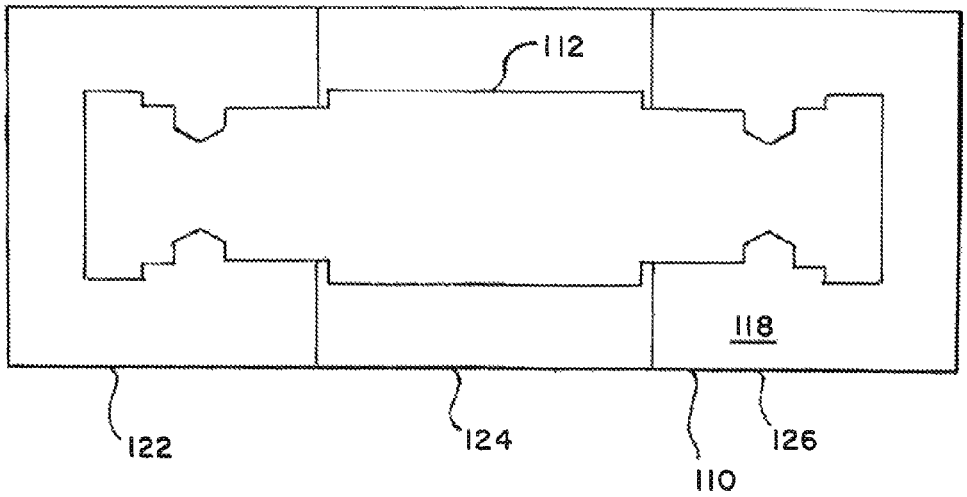
FIG. 19 is a top view of a bolster drag flask with a near net shape oversized impression of a bolster drag pattern formed therein in accordance with an embodiment of the present invention.

Referring now to FIGS. 18 and 19, a bolster drag flask is shown generally at 110. Such bolster drag flask 110 is typically comprised of cast steel sections 122, 124, and 126, with each section bolted together as shown and will be described below with reference to FIG. 21. However, such bolster drag flask 110 may be comprised of a single piece, typically of cast steel.

Each component bolster drag flask section is comprised of cast steel with an oversized impression of a bolster drag portion formed as 112 on the top surface 118 of bolster drag flask 110. Engineering judgment and foundry practice is used in the degree of oversizing required for oversize impression 112 of the bolster drag flask. The reason for such engineering judgment is that an exact pattern of the bolster drag will be placed on top of bolster drag flask 110; accordingly, a spacing will be formed between pattern edge 114 and oversized impression 112. It should be considered part of the present invention to place the bolster drag flask on top of the pattern as a matter of foundry practice choice. A resin sand will form resin sand layer 116 between pattern edge 114 and oversize impression 112 in bolster drag flask 110. The thickness of resin sand layer 116 is based on engineering design and foundry practice and typically will be between 3 and 15 percent larger than the volume formed by bolster drag pattern edge 114. Another engineering judgment applying to the resin sand layer 116 is the overall thickness of such resin sand layer; a typical thickness of such resin sand layer will be 0.5 to 1.5 inches (1.2 cm to 3.8 cm) or more.

It should be understood that the preferred material for sideframe drag flask 110 is cast steel, but certainly cast iron could be utilized as well.

Figure 21:
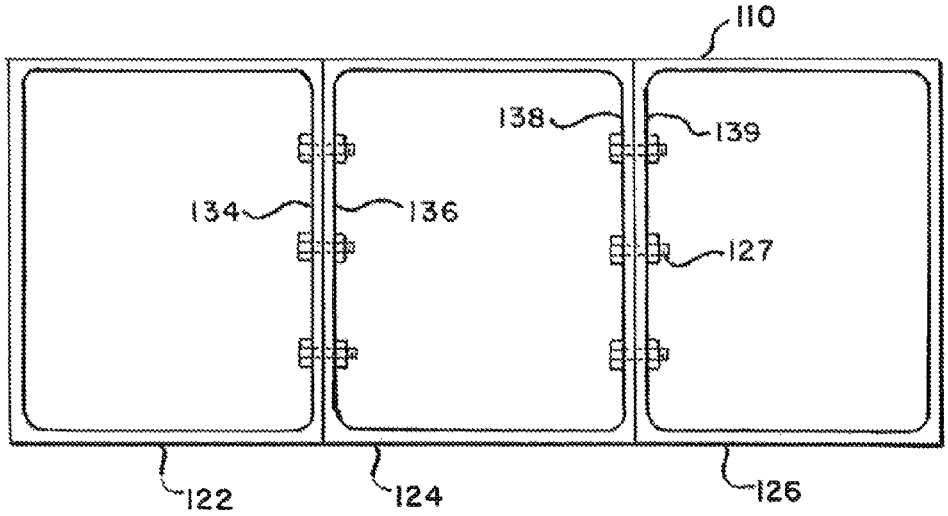
FIG. 21 is a view of the underside of a drag flask for a bolster in accordance with an embodiment of the present invention.

Referring now to FIG. 21, separate sections 122, 124, and 126 of bolster drag flask 110 are shown in a bottom view. In order to save weight and material, each of sections 122, 124, and 126 of bolster drag flask 110 are generally hollow structures with a framing utilized for strength. Such framing typically comprises the outside edges, with internal edge 134 of section 122 being bolted or welded to sidewall 136 of middle section 124. The other sidewall 138 of middle section 124 is bolted by bolt nut combination 127 to the sidewall 139 of section 126 of bolster drag flask 110. Other methods of joining the three or more sections of bolster drag flask 110 could include welding or other equivalent methods of joining the adjacent internal walls 134 to 136 and 138 to 139.

Figure 20:
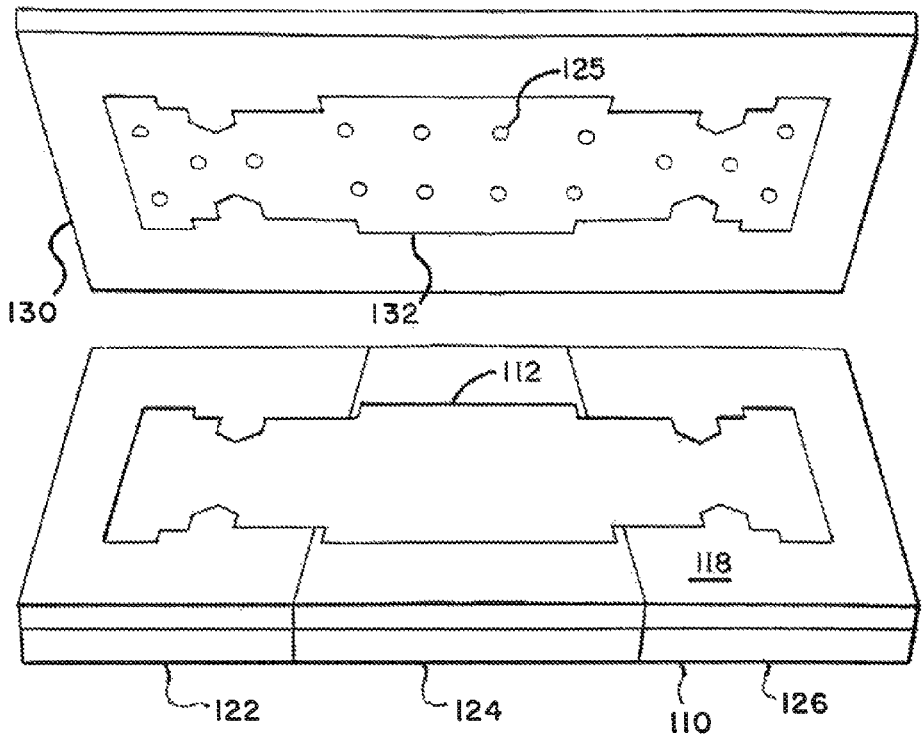
FIG. 20 is a perspective view of a drag portion of a bolster pattern above a drag flask with a near net shape oversize impression of a bolster drag pattern formed therein in accordance with an embodiment of the present invention.

Referring now to FIG. 20, bolster drag pattern support structure or plate 130 is shown in a perspective view above bolster drag flask 110. Bolster drag pattern 132 is affixed to bolster drag pattern support structure 130. Further, sand injection openings 125 are placed in an engineered design fashion throughout bolster drag pattern 132 and through plate 130. Some of the sand injection openings 125 do not extend through bolster drag pattern 132 but extend through plate 130. Such sand injection openings typically are comprised of openings to allow the passage of sand, and also for the passage of a catalyst gas, through bolster drag pattern support structure 130 and bolster drag pattern 132, in addition to sand injection openings 125, a number of exhaust openings 125A with screens are provided in bolster drag pattern 132 and drag pattern support structure 130. These exhaust openings 125A are mainly in areas that will not receive steel to form the casting.

Figure 22:
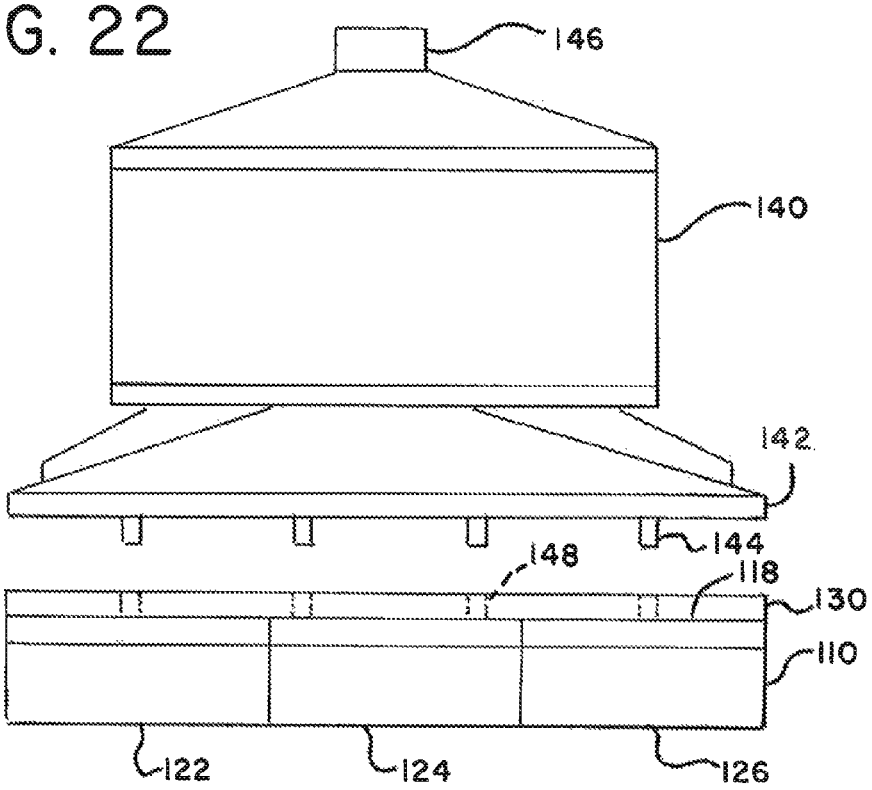
FIG. 22 is a side view of a bolster drag pattern in a sand blowing machine above a bolster drag flask in accordance with an embodiment of the present invention.

Referring now to FIG. 22, sand blowing machine for use with permanent bolster drag flask 110 and bolster drag pattern 132 is shown generally at 140. Such sand blowing machine 140 is comprised of a generally rectangular structure having an upper sand blowing machine connection whereby resin coated sand from a sand hopper is allowed to flow into sand blowing machine 140. Sand blowing machine 140 also includes a sand injection machine plate 142 which includes sand blow tubes 144 that are designed in an engineered fashion to correspond with sand injection openings 125 in bolster drag pattern 132. When sideframe drag pattern 110 has bolster pattern support structure 130 placed on top of bolster drag flask 110, it is noted that bolster drag pattern support structure 130 includes sand injection openings 148 which correspond with sand injection openings 125 in bolster drag pattern 132. When bolster drag pattern support structure 130 is placed in contact with sand blowing machine header 142, sand injection outlets 144 pass through sand injection openings 148 in bolster drag pattern support structure 130. In an actual mold forming operation, a resin coated sand, most typically a gas set resin, is used, but it should be understood that other resins can be used to coat sand prior to injection into the spacing between bolster drag pattern 132 and oversized impression 112 in the bolster drag flask 110. Such sand injection forms resin sand layer 116 between bolster drag pattern 132 and oversized impression 112 in bolster drag flask 110.

Figure 23:
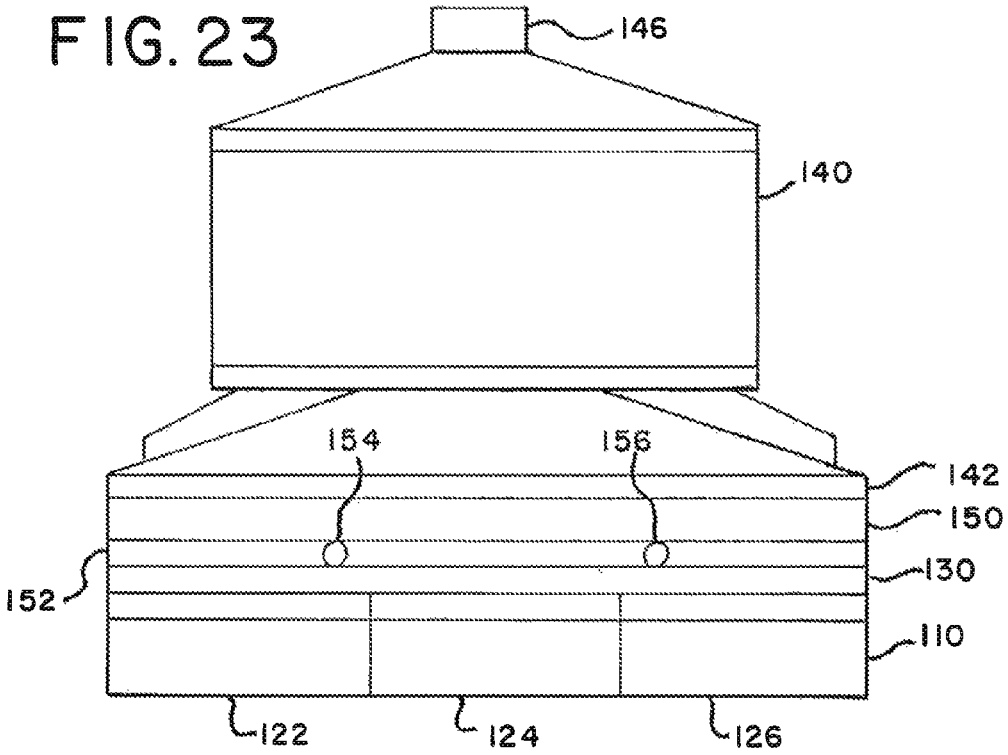
FIG. 23 is a side view of a gassing plate in a sand blowing machine positioned on top of a drag portion of a bolster pattern positioned on top of a drag flask in accordance with an embodiment of the present invention.

Referring now to FIG. 23, a gas injection plate 150 for a bolster drag pattern is placed between sand blowing machine header 142 and bolster drag pattern support structure 130. Gas injection plate 150 for bolster drag section is seen to include a gas injection header dispersion section 152 which is placed adjacent bolster pattern support structure 130. Gas injection plate dispersion section 152 is seen to include gas injection inlets 154 and 156.

The operation of the gas injection plate 150 usually includes the injection of a gas catalyst which reacts with the resin coated sand to form resin sand layer 116 between pattern 114 of bolster drag section and oversize impression 112 in the bolster drag flask. The typical gas injection period is engineered depending on the thickness of resin sand layer 116 and the overall size of the bolster drag pattern 132 and the number of inlet gas injection openings, also referred to as sand injection openings 125, in bolster drag pattern 132.

Figure 24:
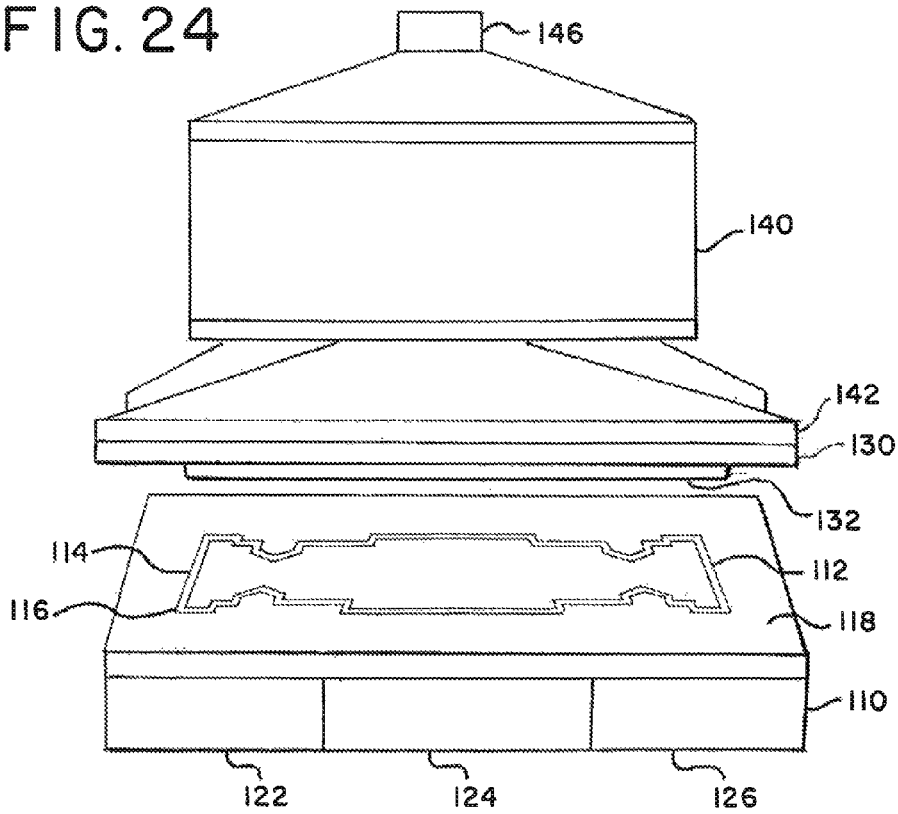
FIG. 24 is a perspective view of a drag portion of a bolster pattern in a sand blowing machine above a bolster drag flask after the injection of the molding sand and then the gas catalyst to form a bolster drag pattern mold in the bolster drag flask in accordance with an embodiment of the present invention.

Referring now to FIG. 24, sand blowing machine 140 for bolster drag pattern 132 is seen to be lifted vertically away from bolster drag flask 110 after the injection of the resin coated sand and the gas set operation. Accordingly, a layer 116 of resin coated sand is formed in bolster drag flask 110 between the inside dimension of bolster drag pattern 132 and the outside dimension of the oversize impression 112 in bolster drag flask 110.

Figure 25:
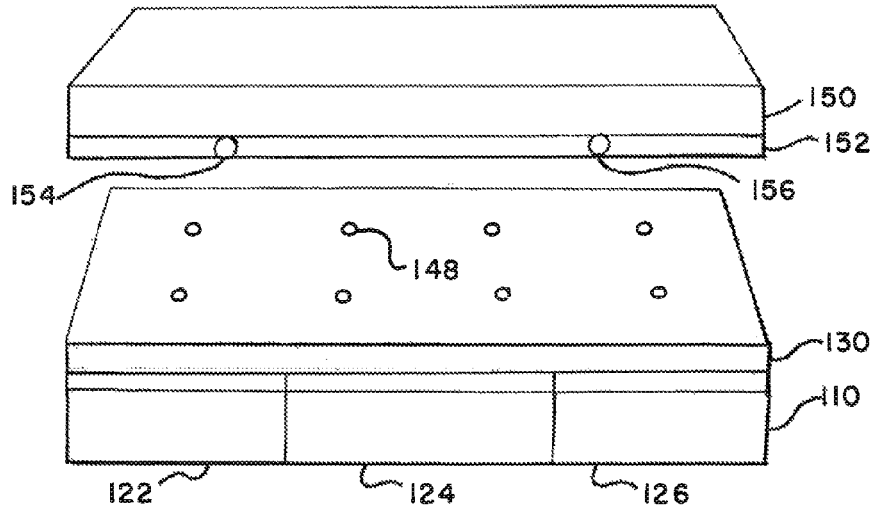
FIG. 25 is a perspective view of a gassing plate above a bolster drag pattern on top of a bolster drag flask in accordance with an embodiment of the present invention.

Referring now to FIG. 25, a detailed perspective view of bolster drag flask 110 is shown with bolster drag pattern support structure 130 thereon. Sand and gas injection openings 148 are shown in bolster drag pattern support structure 130. Further, gas injection plate 150 is shown with a gas injection plate dispersion section 152 as a bottom section thereof with a gas injection inlets 154 and 156. Most typically, gas injection plate 150 is a metal rectangular structure, having a type of sealing device such as a gasket or other designed material between gas injection header dispersion section 152 lower outside edge and the upper surface of bolster drag pattern support structure 130.

Figure 26:
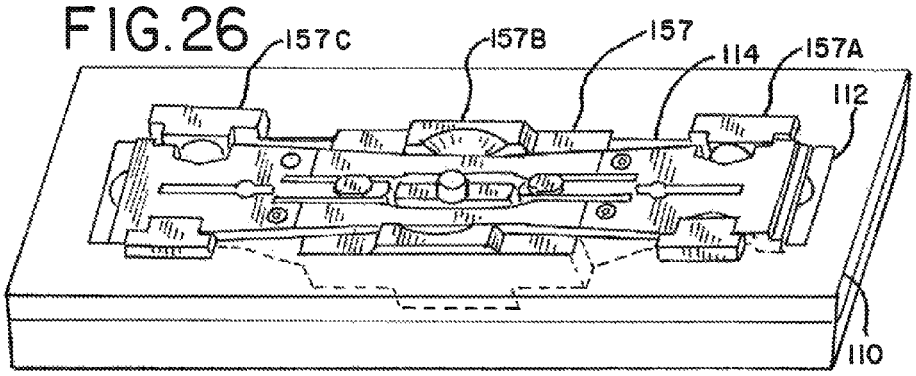
FIG. 26 is a perspective view of a bolster drag mold in a bolster drag flask with cores installed in accordance with an embodiment of the present invention.

Referring now to FIG. 26, a plurality of cores 157 are placed in the bolster drag sand layer 116 formed in bolster drag flask 110. It is seen that such bolster drag pattern cores usually comprise an end core section 157A, a center core sections 157B, and another end core section 157C. Such core sections are made of a resin set sand.

Another aspect of the present invention are the weights and relative weights of the cast steel bolster and the layer of resin coated sand formed to the drag pattern in the drag flask. Typically, a cast steel bolster for use in a modern freight car truck weighs about 1000 lb. (455 kg.). The weight of resin coated sand lining the bolster drag flask is between 150 and 250 lb. (68 and 115 kg). Accordingly, a ratio of resin coated liner sand in the drag flask to the weight of the cast steel bolster is about 0.2 to 1.0.

Figure 27:
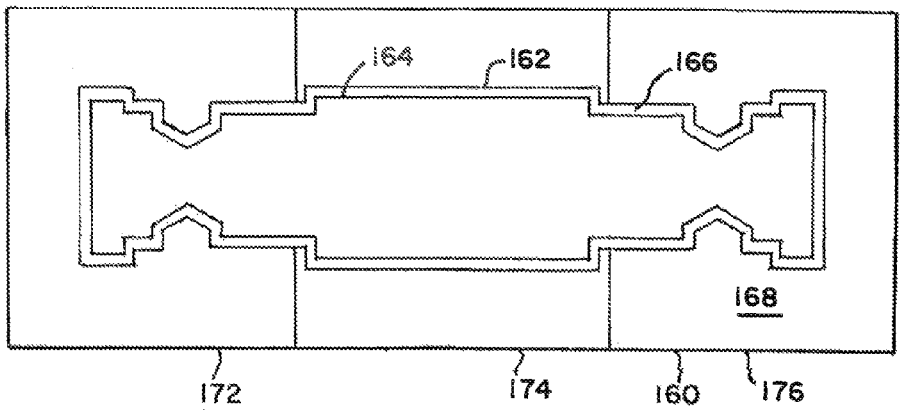
FIG. 27 is a top view of a bolster cope mold in a bolster cope flask in accordance with an embodiment of the present invention.
Figure 28:
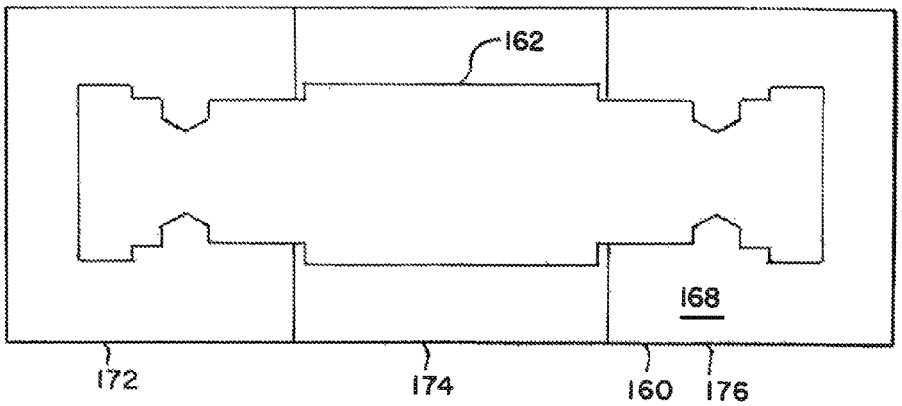
FIG. 28 is a top view of a bolster cope flask with a near net shape oversize impression of a bolster cope pattern formed therein in accordance with an embodiment of the present invention.

Referring now to FIGS. 27 and 28, a holster cope flask is shown generally at 160. Such bolster cope flask is typically comprised of cast steel sections 162, 164, and 166, with each section bolted together as shown and will be described below with reference to FIG. 30. However, bolster cope flask 160 may be comprised of a single piece, typically a steel casting.

Each component bolster cope flask section is comprised of cast steel with an oversize impression of a bolster cope portion formed on the top surface 168 of bolster cope flask 160. Inventive engineering judgment and foundry practice is used in the degree of oversizing required for impression 162 of the bolster cope flask. The reason for such engineering judgment is that an exact pattern of the bolster cope will be placed on top of bolster cope flask 160; accordingly, a spacing will be formed between pattern edge 164 and oversized impression 162. A resin sand will form resin sand layer 166 between pattern edge 164 and oversize impression 162 in bolster cope flask 160. The thickness of resin sand layer 166 is based on inventive engineering design and foundry practice and typically will be between 3 and 15 percent larger than the volume formed by bolster cope pattern edge 164. Another inventive engineering judgment applying to the resin sand layer 166 is the overall thickness of such resin sand layer; a typical thickness of such resin sand layer will be 0.5 to 1.5 inches (1.2 cm and 3.8 cm) or more.

It should be understood that the preferred material for bolster cope flask 160 is cast steel, but certainly cast iron could be utilized as well.

Figure 30:
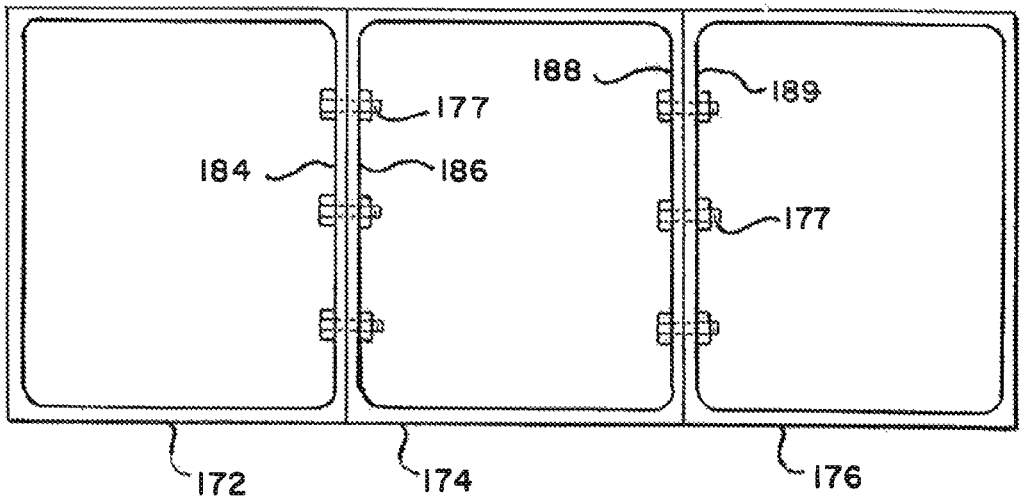
FIG. 30 is a view of the underside of a bolster cope flask in accordance with an embodiment of the present invention.

Referring now to FIG. 30, separate sections 172, 174, and 176 of bolster cope flask 110 are shown in a bottom view. In order to save weight and material, each of sections 172, 174, and 176 of bolster cope flask 160 are generally hollow structures with a framing utilized for strength. Such framing typically comprises the outside edges, with internal edge 184 of section 172 being bolted or welded to sidewall 186 of middle section 174. The other sidewall 188 of middle section 174 is bolted by bolt nut combination 177 to the sidewall 189 of section 176 of bolster cope flask 160. Other methods of joining the three or more sections of bolster cope flask 160 could include welding or other equivalent methods of joining the adjacent internal walls 184 to 186 and 188 to 189.

Figure 29:
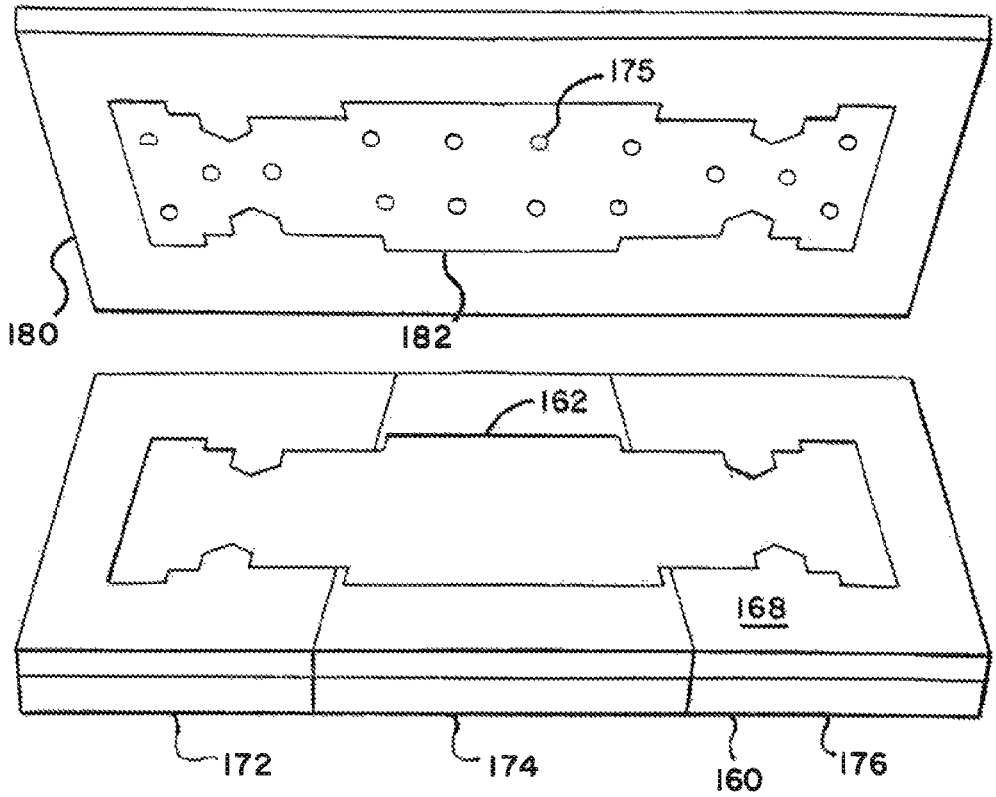
FIG. 29 is a perspective view of a bolster cope pattern above a bolster cope flask with a near net shape oversized impression of a bolster cope pattern formed therein in accordance with an embodiment of the present invention.

Referring now to FIG. 29, bolster cope pattern support structure or plate 180 is shown in a perspective view above bolster cope flask 160. Bolster cope pattern 182 is affixed to bolster cope pattern support structure 180. Further, sand injection openings 175 are placed in an engineered design fashion throughout bolster cope pattern 182 and through plate 180. Some of sand injection openings 175 do not extend through bolster cope pattern 182 but extend through plate 180. Such sand injection openings typically are comprised of openings to allow the passage of sand, and also for the passage of a catalyst gas, through bolster cope pattern support structure 180 and bolster cope pattern 182. In addition to sand injection openings 175, a number of exhaust openings 175A with screens are provided in bolster cope pattern 32 and bolster cope pattern support structure 180. These exhaust openings 175A are mainly in areas that will not receive steel to form the casting.

Figure 31:
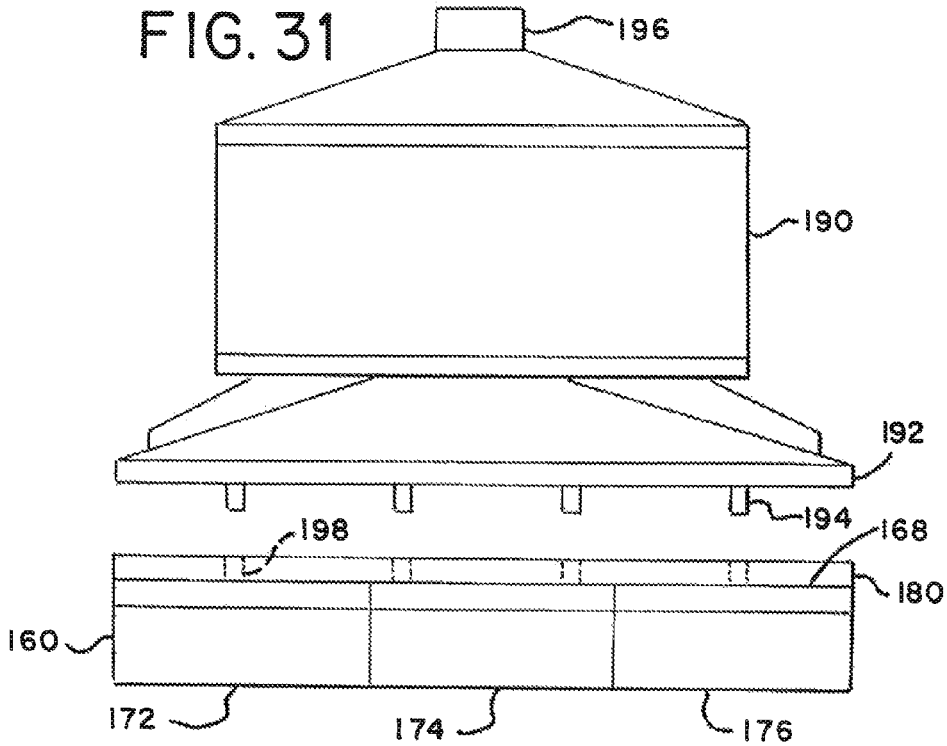
FIG. 31 is a side view of a bolster cope pattern in a sand blowing machine above a bolster cope flask in accordance with an embodiment of the present invention.

Referring now to FIG. 31, sand blowing machine for use with bolster cope flask 160 and bolster cope pattern 182 is shown generally at 190. Such sand blowing machine is comprised of a generally rectangular structure having an upper sand blowing machine connection whereby resin coated sand from a sand hopper is allowed to flow into sand blowing machine 190. Sand blowing machine 190 also includes a sand blowing machine plate 192 which includes sand blow tubes 194 that are designed in an engineered fashion to correspond with sand injection openings 175 in bolster cope pattern 182. When bolster cope pattern 182 and bolster pattern support structure 180 are placed on top of bolster cope flask 160, it is noted that bolster cope pattern support structure 180 includes sand injection openings 198 which correspond with sand injection openings 175 in bolster cope pattern 182. When bolster cope pattern support structure 180 is placed in contact with sand blowing machine header 192, sand blow tubes 194 pass through sand injection openings 198 in bolster cope pattern support structure 180. In an actual mold forming operation, a resin coated sand is used, but it should be understood that other resins can be used to coat sand prior to injection into the spacing between bolster cope pattern 182 and oversize impression 162 in the bolster cope flask 160. Such sand injection forms resin sand layer 166 between bolster cope pattern edge 164 and oversized impression 162 in bolster cope flask 160.

Another feature of the present invention is that resin sand layer 166 can be formed with a minimum number of gas vents on the pattern which allow a cast steel bolster to be formed with minimum number of raised projections that correspond to each gas vent.

Figure 32:
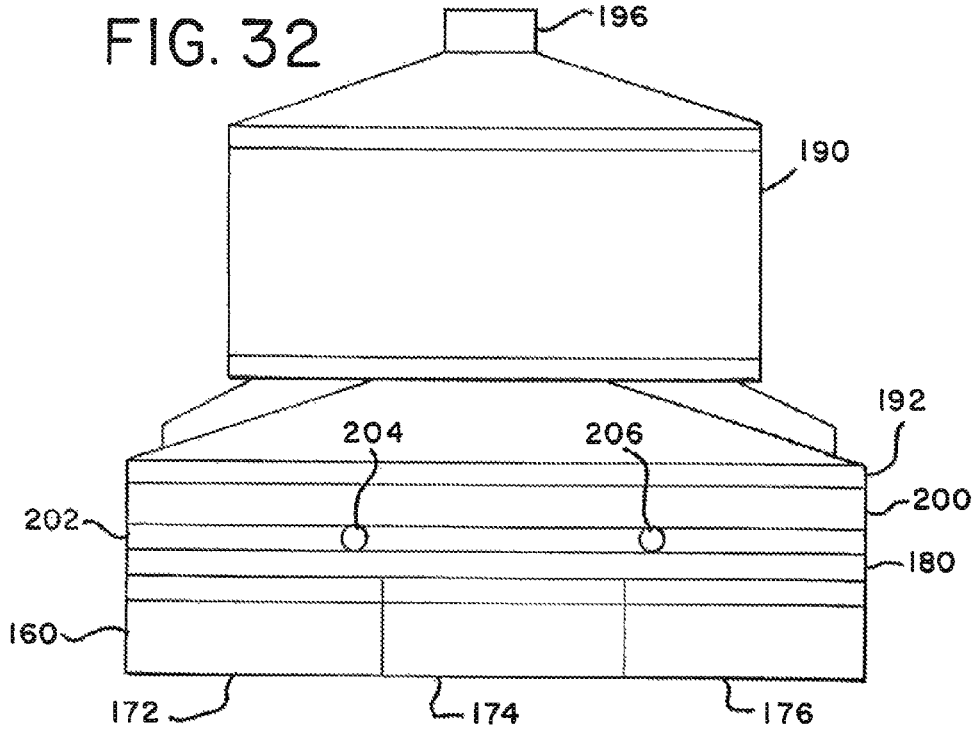
FIG. 32 is a side view of a gassing plate in a sand blowing machine positioned on top of a bolster cope pattern positioned on top of a bolster cope flask in accordance with an embodiment of the present invention.

Referring now to FIG. 32, a gas injection plate 200 for a bolster cope pattern is placed between sand blowing machine header 192 and bolster cope pattern support structure 180. Gas injection plate 200 for bolster cope section is seen to include a gas injection plate dispersion section 202 which is placed adjacent bolster cope pattern support structure 180. Gas injection plate dispersion section 202 is seen to include gas injection inlets 204 and 206.

The operation of the gas injection plate 200 usually includes the injection of a gas catalyst which reacts with the resin coated sand to form resin sand layer 166 between pattern edge 164 of bolster cope pattern and oversize impression 162 in the bolster cope flask. The typical gas injection period is engineered depending on the thickness of resin sand layer 166 and the overall size of the bolster cope pattern 182 and the number of inlet gas injection openings, also referred to as sand injection openings 175, in bolster cope pattern 182.

Figure 33:
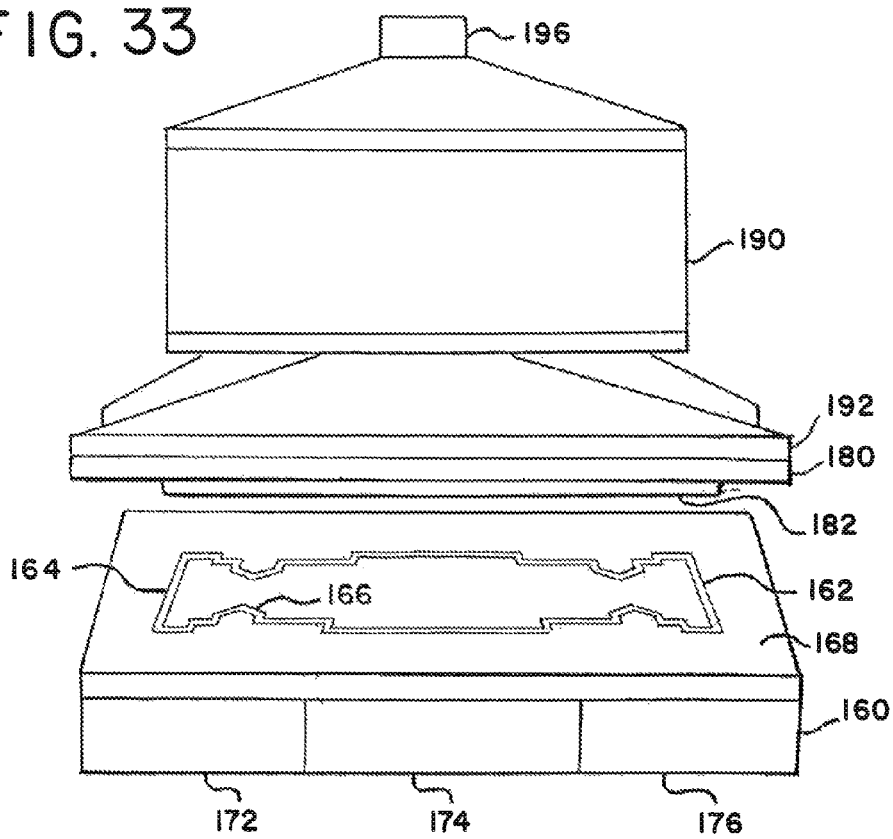
FIG. 33 is a perspective view of a bolster cope pattern in a sand blowing machine above a bolster cope flask after the injection of the molding sand and then the gas catalyst to form a bolster cope mold in the bolster cope flask in accordance with an embodiment of the present invention.

Referring now to FIG. 33, sand blowing machine 190 for bolster cope pattern 182 is seen to be lifted vertically away from bolster cope flask 160 after the injection of the resin coated sand and the gas set operation. Accordingly, a layer 166 of resin coated sand is formed in bolster flask 160 between the inside dimension of bolster cope pattern 164 and the outside dimension of the oversize impression 162 in bolster cope flask 160.

Figure 34:
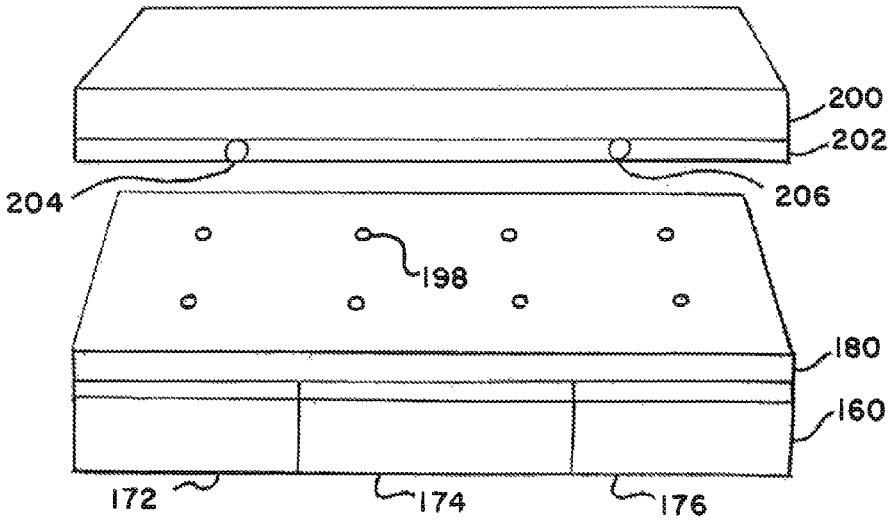
FIG. 34 is a perspective view of a gassing plate above a bolster cope pattern on top of a bolster cope flask in accordance with an embodiment of the present invention.

Referring now to FIG. 34, a detailed perspective view of bolster cope flask 160 is shown with bolster cope pattern support structure 180 thereon. Sand and gas injection openings 198 are shown in bolster cope pattern support structure 160. Further, gas injection plate 200 is shown with a gas injection plate dispersion section 202 as a bottom section thereof with a gas injection inlets 204 and 206. Most typically, gas injection plate 200 is a metal rectangular structure, having a type of sealing device such as a gasket or other designed material between gas injection header dispersion section 202 lower outside edge and the upper surface of bolster cope pattern support structure 180.

Another aspect of the present invention are the weights and relative weight of the cast steel bolster and the layer of resin coated sand formed to the bolster cope pattern in the cope flask. Typically, a cast steel bolster for use in a modern freight car truck weighs about 1000 lb. (455 kg.). The weight of resin coated sand lining the bolster cope flask is between 150 and 250 lb. (68 and 115 kg). Accordingly, a ratio of resin coated liner sand in the bolster cope flask to the weight of the cast steel bolster is about 0.2 to 1.0.

Figure 35:
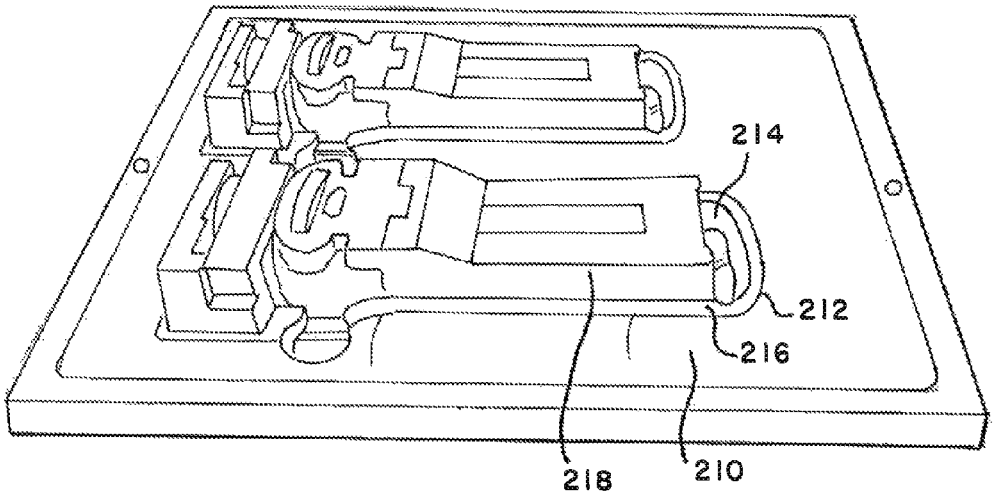
FIG. 35 is a perspective view of a coupler yoke drag mold in a coupler yoke drag flask with cores installed in accordance with an embodiment of the present invention.

Referring now to FIG. 35, a railway car coupler yoke drag flask is shown generally at 210. Such yoke drag flask 210 is typically comprised of cast steel sections bolted together. However, yoke drag flask 210 may also be comprised of a single piece, usually a steel casting.

Each component yoke drag flask section is comprised of cast steel with an near net shape oversized impression of a yoke drag pattern formed as 212 on the top surface of yoke drag flask 210. Engineering judgment and foundry practice is used in the degree of oversizing required for near net shape oversized impression 212 of the yoke drag flask. The reason for such engineering judgment is that an exact pattern of the yoke drag will be placed on top of yoke drag flask 210; accordingly, a spacing will be formed between pattern edge 214 and oversized impression 212. A resin sand will form resin sand layer 216 between pattern edge 214 and oversized impression in yoke drag flask 210. The thickness of resin sand layer 216 is based on engineering design and foundry practice and typically will be between 3 and 15 percent larger than the volume formed by yoke drag pattern edge 214. Another engineering judgment applying to the resin sand layer 216 is the overall thickness of such resin sand layer; a typical thickness of such resin sand layer will be 0.5 to 1.5 inches (1.2 cm to 3.8 cm) or more. A plurality of cores 218 are placed in yoke drag resin sand layer 216.

It should be understood that the preferred material for yoke drag flask 210 is cast steel, but certainly cast iron could be utilized as well. It should also be understood that foundry practice may prefer that the drag flask is placed over the pattern to form the opening therebetween.

Figure 36:
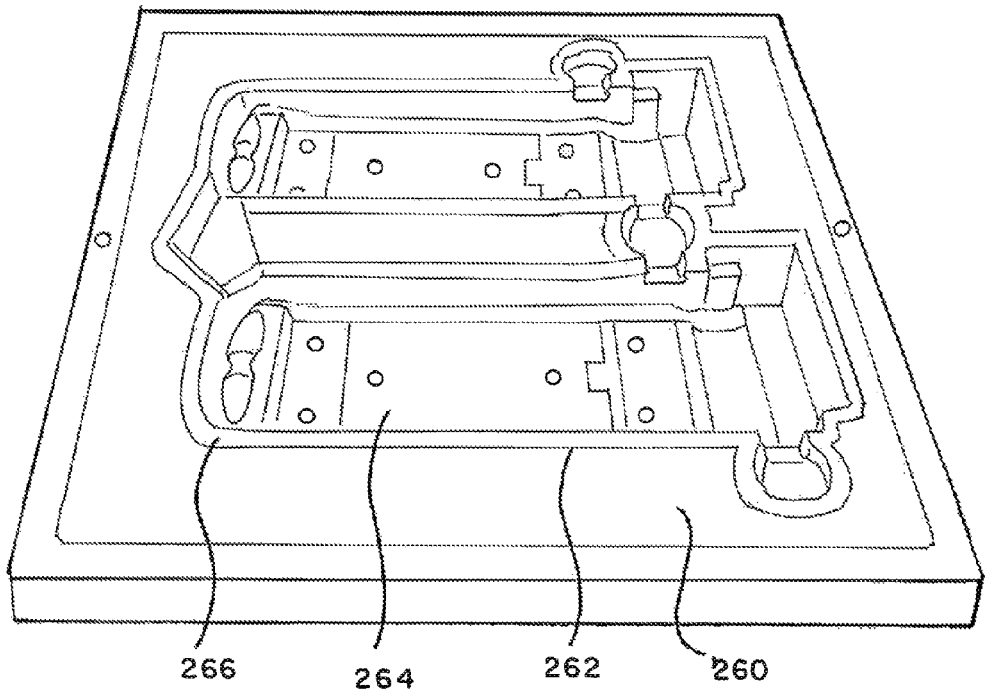
FIG. 36 is a perspective view of a coupler yoke cope mold in a coupler yoke cope flask in accordance with an embodiment of the present invention.

Referring now to FIG. 36, a railway car coupler yoke cope flask is shown generally at 260. Such yoke cope flask is typically comprised of cast steel sections with each section bolted together. However, yoke cope flask 260 may be comprised of a single piece, typically a steel casting.

Each component yoke cope flask section is comprised of cast steel with an oversized impression of a yoke cope portion formed as 262 on the top surface of yoke cope flask 260. Inventive engineering judgment and foundry practice is used in the degree of oversizing required for impression 262 of the yoke cope flask. The reason for such engineering judgment is that an exact pattern of the yoke cope will be placed on top of yoke cope flask 260; accordingly, a spacing will be formed between pattern edge 264 and oversized impression 262. A resin sand will form resin sand layer 266 between pattern edge 264 and oversized impression 262 in yoke cope flask 260. The thickness of resin sand layer 266 is based on inventive engineering design and foundry practice and typically will be between 3 and 15 percent larger than the volume formed by yoke cope pattern edge 264. Another inventive engineering judgment applying to the resin sand layer 266 is the overall thickness of such resin sand layer; a typical thickness of such resin sand layer will be 0.5 to 1.5 inches (1.2 cm to 3.8 cm) or more.

It should be understood that the preferred material for permanent yoke cope flask 260 is cast steel, but certainly cast iron could be utilized as well, it should also be understood that foundry practice may prefer that the drag flask is placed over the pattern to form the opening therebetween.

Details of the gas setting of the resin sand in the yoke drag and cope flasks and forming of a complete railway car coupler yoke mold are not set forth here but would be similar to the processes set forth above for the sideframe and bolster molds.

Figure 37:
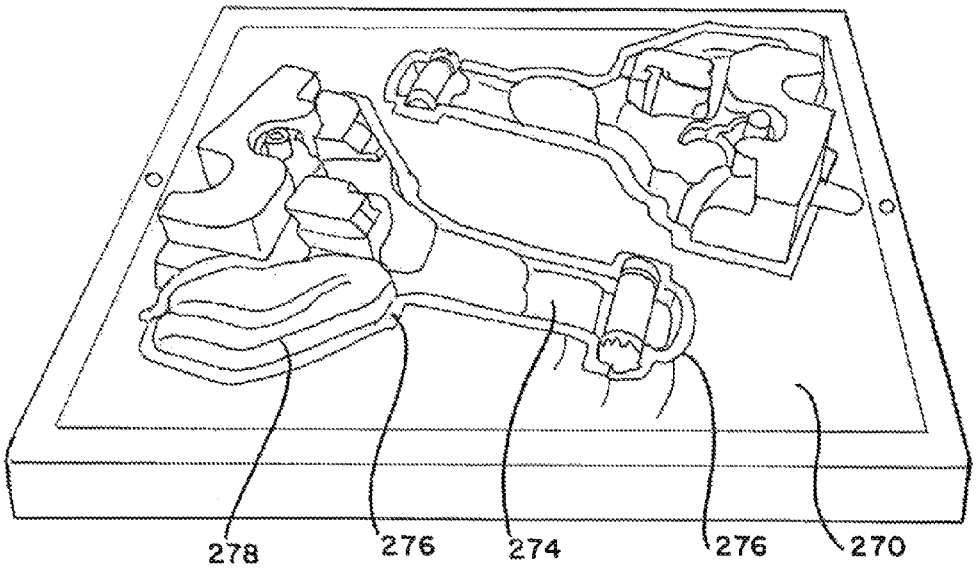
FIG. 37 is a perspective view of a coupler body drag mold in a coupler body drag flask with cores installed in accordance with an embodiment of the present invention.

Referring now to FIG. 37, a railway car coupler body drag flask is shown generally at 270. Such coupler drag flask 270 is typically comprised of cast steel sections bolted together. However, coupler drag flask 270 may also be comprised of a single piece, usually a steel casting.

Each component coupler drag flask section is comprised of cast steel with an near net shape oversized impression of a coupler drag pattern formed as 272 on the top surface of coupler drag flask 270. Engineering judgment and foundry practice is used in the degree of oversizing required for near net shape oversized impression 272 of the coupler drag flask. The reason for such engineering judgment is that an exact pattern of the coupler drag will be placed on top of coupler drag flask 270; accordingly, a spacing will be formed between pattern edge 274 and oversized impression 272. A resin sand will form resin sand layer 276 between pattern edge 274 and oversized impression 272 in coupler drag flask 270. The thickness of resin sand layer 276 is based on engineering design and foundry practice and typically will be between 3 and 15 percent larger than the volume formed by coupler drag pattern edge 274. Another engineering judgment applying to the resin sand layer 276 is the overall thickness of such resin sand layer; a typical thickness of such resin sand layer will be 0.5 to 1.5 inches (1.2 cm to 3.8 cm) or more. A plurality of cores 278 are placed in coupler drag resin sand layer 276.

It should be understood that the preferred material for coupler drag flask 270 is cast steel, but certainly cast iron could be utilized as well. It should also be understood that foundry practice may prefer that the drag flask is placed over the pattern to form the opening therebetween.

Figure 38:
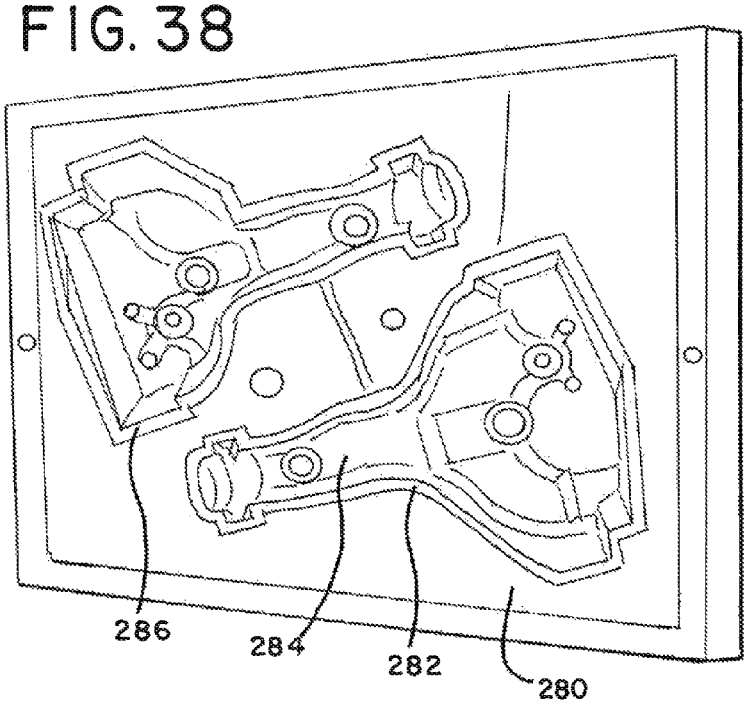
FIG. 38 is a perspective view of a coupler body cope mold in a coupler body cope flask in accordance with an embodiment of the present invention.

Referring now to FIG. 38, a railway ear coupler body cope flask is shown generally at 280. Such coupler cope flask is typically comprised of cast steel sections with each section bolted together. However, coupler cope flask 280 may be comprised of a single piece, typically a steel casting.

Each component coupler cope flask section is comprised of cast steel with an oversized impression of a coupler cope portion formed as 282 on the top surface of coupler cope flask 280. Inventive engineering judgment and foundry practice is used in the degree of oversizing required for impression 282 of the coupler cope flask. The reason for such engineering judgment is that an exact pattern of the coupler cope will be placed on top of coupler cope flask 280; accordingly, a spacing will be formed between pattern edge 284 and oversized impression 282. A resin sand will form resin sand layer 286 between pattern edge 284 and oversized impression 282 in coupler cope flask 280. The thickness of resin sand layer 286 is based on inventive engineering design and foundry practice and typically will be between 3 and 15 percent larger than the volume formed by coupler cope pattern edge 284. Another inventive engineering judgment applying to the resin sand layer 286 is the overall thickness of such resin sand layer; a typical thickness of such resin sand layer will be 0.5 to 1.5 inches (1.2 cm to 3.8 cm) or more.

It should be understood that the preferred material for coupler cope flask 280 is cast steel, but certainly cast iron could be utilized as well. It should also be understood that foundry practice may prefer that the drag flask is placed over the pattern to form the opening therebetween.

Details of the gas setting of the resin sand in the coupler drag and cope flasks and forming of a complete railway car coupler body mold are not set forth here hut would be similar to the processes set forth above for the sideframe and bolster molds.

What is claimed is:

1. A method of forming a mold for use in the production of a railway freight car sideframe, the steps comprising:

providing a sideframe drag flask, the sideframe drag flask including an oversize impression integral with the sideframe drag flask, the oversize impression and sideframe drag flask comprising at least one of cast steel and cast iron, providing a sideframe drag pattern, the oversize impression being an impression having a shape related to the sideframe drag pattern, placing the sideframe drag pattern on top of the sideframe drag flask to form a spacing between the sideframe drag pattern and the oversize impression in the sideframe drag flask, injecting a resin coated sand into the spacing between the sideframe drag pattern and the oversize impression in the sideframe drag flask through a plurality of openings in the sideframe drag pattern to form a layer of resin coated sand in the spacing between the sideframe drag pattern and the oversize impression in the sideframe drag flask, injecting a gas catalyst into the layer of resin coated sand to set the resin coated sand to form a sideframe drag mold in the sideframe drag flask, providing a sideframe cope flask, the sideframe cope flask including an oversize impression integral with the sideframe cope flask, the oversize impression and sideframe cope flask comprising at least one of cast steel and cast iron, providing a sideframe cope pattern, the oversize impression in the sideframe cope flask being an impression having a shape related to the sideframe cope pattern, placing the sideframe cope pattern of the on top of the sideframe cope flask to form a spacing between the sideframe cope pattern and the oversize impression in the sideframe cope flask, injecting a resin coated sand into the spacing between the sideframe cope pattern and the oversize impression in the sideframe cope flask through a plurality of openings in the sideframe cope pattern to form a layer of resin coated sand in the spacing between the sideframe cope pattern and the oversize impression in the sideframe cope flask, injecting a gas catalyst into the layer of resin coated sand to set the resin coated sand to form a sideframe cope mold in the sideframe cope flask, placing a plurality of cores in the sideframe drag mold, and placing the sideframe cope flask with the sideframe cope mold on top of the sideframe drag flask with the sideframe drag mold to form a complete mold ready to receive molten steel to form a railway freightcar sideframe.

2. The method of forming a mold of claim 1 wherein the sideframe drag flask is comprised of one or more sections, with each section comprised of cast steel, and each section having an upper portion in which a portion of the sideframe drag pattern is formed, and a lower portion which is comprised of structural support members, the assembled sideframe drag flask being of a rigid structure to avoid distortion in the steel casting.

3. The method of forming a mold of claim 1 wherein the sideframe drag mold formed in the sideframe drag flask is formed with gas vents mainly in areas that will not receive molten steel.

4. The method of forming a mold of claim 1 wherein the sideframe cope mold formed in the sideframe cope flask is formed with gas vents mainly in areas that will not receive molten steel.

5. The method of forming a mold of claim 1 wherein the resin coated sand forming the sideframe drag mold in the sideframe drag flask is injected to a thickness of 0.5 to 1.5 inches (1.27 to 3.80 cm).

6. The method of forming a mold of claim 1 wherein the resin coated sand forming the sideframe cope mold in the sideframe cope flask is injected to a thickness of 0.5 to 1.5 inches (1.27 to 3.80 cm).

7. The method of forming a mold of claim 1 wherein the weight of the resin coated sand injected into the sideframe drag flask is between 150 and 250 pounds (68 and 102 kg).

8. The method of forming a mold of claim 1 wherein the weight of the resin coated sand injected into the sideframe cope flask is between 150 and 250 pounds (68 and 102 kg).

9. The method of forming a mold of claim 1 wherein the weight of the resin coated sand injected into the sideframe drag flask compared to the weight of the sideframe is a ratio of about 0.2 to 1.0.

10. The method of forming a mold of claim 1 wherein the weight of the resin coated sand injected into the sideframe cope flask compared to the weight of the sideframe is a ratio of about 0.2 to 1.0.

11. A method of forming a mold for use in the production of a railway freight car bolster, the steps comprising:

providing a bolster drag flask, the bolster drag flask including an oversize impression integral with the bolster drag flask, the oversize impression and bolster drag flask comprising at least one of cast steel and cast iron, providing a bolster drag pattern, the oversize impression being an impression having a shape related to the bolster drag pattern, placing the bolster drag pattern on top of the bolster drag flask to form a spacing between the bolster drag pattern and the oversize impression in the bolster drag flask, injecting a resin coated sand into the spacing between the bolster drag pattern and the oversize impression in the bolster drag flask through a plurality of openings in the bolster drag pattern to form a layer of resin coated sand in the spacing between the bolster drag pattern and the oversize impression in the bolster drag flask, injecting a gas catalyst into the layer of resin coated sand to set the resin coated sand to form a bolster drag mold in the bolster drag flask, providing a bolster cope flask, the bolster cope flask including an oversize impression integral with the bolster cope flask, the oversize impression and bolster cope flask comprising at least one of cast steel and cast iron, providing a bolster cope pattern, the oversize impression in the bolster cope flask being an impression having a shape related to the bolster cope pattern, placing the bolster cope pattern of the on top of the bolster cope flask to form a spacing between the bolster cope pattern and the oversize impression in the bolster cope flask, injecting a resin coated sand into the spacing between the bolster cope pattern and the oversize impression in the bolster cope flask through a plurality of openings in the bolster cope pattern to form a layer of resin coated sand in the spacing between the bolster cope pattern and the oversize impression in the bolster cope flask, injecting a gas catalyst into the layer of resin coated sand to set the resin coated sand to form a bolster cope mold in the bolster cope flask, placing a plurality of cores in the bolster drag mold, and placing the bolster cope flask with the bolster cope mold on top of the bolster drag flask with the bolster drag mold to form a complete mold ready to receive molten steel to form a railway freightcar bolster.

12. The method of forming a mold of claim 11 wherein the bolster drag flask is comprised of one or more sections, with each section comprised of cast steel, and each section having an upper portion in which a portion of the bolster drag pattern is formed, and a lower portion which is comprised of structural support members, the assembled bolster drag flask being of a rigid structure to avoid distortion in the bolster when cast.

13. The method of forming a mold of claim 11 wherein the bolster drag mold formed in the bolster drag flask is formed with gas vents mainly in areas that will not receive molten steel.

14. The method of forming a mold of claim 11 wherein the bolster cope mold formed in the bolster cope flask is formed with gas vents mainly in areas that will not receive molten steel.

15. The method of forming a mold of claim 11 wherein the resin coated sand forming the bolster drag mold in the bolster drag flask is injected to a thickness of 0.5 to 1.5 inches (1.27 to 3.80 cm).

16. The method of forming a mold of claim 11 wherein the resin coated sand forming the bolster cope mold in the bolster cope flask is injected to a thickness of 0.5 to 1.5 inches (1.27 to 3.80 cm).

17. The method of forming a mold of claim 11 wherein the weight of the resin coated sand injected into the bolster drag flask is between 150 and 250 pounds (68 and 102 kg).

18. The method of forming a mold of claim 11 wherein the weight of the resin coated sand injected into the bolster cope flask is between 150 and 250 pounds (68 and 102 kg).

19. The method of forming a mold of claim 11 wherein the weight of the resin coated sand injected into the bolster drag flask compared to the weight of the bolster is a ratio of about 0.2 to 1.0.

20. The method of forming a mold of claim 11 wherein the weight of the resin coated sand injected into the bolster cope flask compared to the weight of the bolster is a ratio of about 0.2 to 1.0.

* * * * *